US012398936B2

(12) United States Patent
Mizuno et al.

(10) Patent No.: US 12,398,936 B2
(45) Date of Patent: Aug. 26, 2025

(54) REFRIGERATION CYCLE DEVICE

(71) Applicant: Mitsubishi Electric Corporation, Tokyo (JP)

(72) Inventors: Yuki Mizuno, Tokyo (JP); Soshi Ikeda, Tokyo (JP); Kosuke Miyawaki, Tokyo (JP); Jun Nishio, Tokyo (JP); Yuji Motomura, Tokyo (JP); Hiroki Washiyama, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 103 days.

(21) Appl. No.: 18/273,777

(22) PCT Filed: Feb. 2, 2021

(86) PCT No.: PCT/JP2021/003709
§ 371 (c)(1),
(2) Date: Jul. 24, 2023

(87) PCT Pub. No.: WO2022/168153
PCT Pub. Date: Aug. 11, 2022

(65) Prior Publication Data
US 2024/0077238 A1 Mar. 7, 2024

(51) Int. Cl.
*F25B 49/02* (2006.01)
*F25B 9/00* (2006.01)
(Continued)

(52) U.S. Cl.
CPC ..... *F25B 49/02* (2013.01); *F25B 9/002* (2013.01); *F25B 41/31* (2021.01); *F25B 47/006* (2013.01); *F25B 2700/21174* (2013.01)

(58) Field of Classification Search
CPC ..... F25B 49/02; F25B 9/002; F25B 41/31; F25B 47/006; F25B 2500/19;
(Continued)

(56) References Cited

U.S. PATENT DOCUMENTS

2019/0277549 A1 9/2019 Nishiyama et al.

FOREIGN PATENT DOCUMENTS

CN 102032698 A 4/2011
CN 102066851 A 5/2011
(Continued)

OTHER PUBLICATIONS

International Search Report and Written Opinion mailed on Mar. 9, 2021, received for PCT Application PCT/JP2021/003709, filed on Feb. 2, 2021, 8 pages including English Translation.
(Continued)

*Primary Examiner* — Kun Kai Ma
(74) *Attorney, Agent, or Firm* — XSENSUS LLP

(57) ABSTRACT

A refrigeration cycle device with a main circuit, a bypass circuit and a supercooling heat exchanger further includes: a controller to control an opening degree of the bypass expansion valve; a first sensor to detect a temperature at the refrigerant inflow side of the evaporator; and a second sensor to detect a pressure of the non-azeotropic mixed refrigerant flowing from the evaporator, wherein the controller controls the opening degree of the bypass expansion valve using temperatures of the evaporator, that is, the temperature at the refrigerant inflow side and a saturated gas temperature of the non-azeotropic mixed refrigerant calculated from the pressure so as to adjust a flow rate of the non-azeotropic mixed refrigerant flowing into the evaporator, to eliminate the temperature difference in the evaporator for suppressing uneven frost formation on the evaporator, and thus to prevent heat exchange performance from degrading.

12 Claims, 19 Drawing Sheets

(51) Int. Cl.
*F25B 41/31* (2021.01)
*F25B 47/00* (2006.01)

(58) Field of Classification Search
CPC ..... F25B 2600/2509; F25B 2600/2513; F25B 2700/1933
See application file for complete search history.

(56) References Cited

FOREIGN PATENT DOCUMENTS

| | | | | | |
|---|---|---|---|---|---|
| JP | 3484866 | B2 | | 1/2004 | |
| JP | 2004-044883 | A | | 2/2004 | |
| JP | 2011-179697 | A | | 9/2011 | |
| JP | 2013011391 | A | * | 1/2013 | |
| WO | WO-2009150761 | A1 | * | 12/2009 | ..... F25B 41/00 |
| WO | 2018/078809 | A1 | | 5/2018 | |
| WO | 2019/021364 | A1 | | 1/2019 | |

OTHER PUBLICATIONS

Office Action dated Jun. 10, 2025 issued in corresponding Chinese patent application No. 202180092266.1 (23 pages; with English translation).

* cited by examiner

REFRIGERATION CYCLE DEVICE

CROSS-REFERENCE TO RELATED APPLICATION

The present application is based on PCT filing PCT/JP2021/003709, filed Feb. 2, 2021, the entire contents of which are incorporated herein by reference.

TECHNICAL FIELD

The present disclosure relates to a refrigeration cycle device.

BACKGROUND ART

In recent years, non-azeotropic mixed refrigerants, which are mixtures of several refrigerants with different boiling points, have attracted attention as refrigerants with low global warming coefficients, and the introduction of such non-azeotropic mixed refrigerants into refrigeration cycle devices is being considered to reduce environmental impact. The conventional refrigeration cycle device having a main circuit and a bypass circuit detects the inlet and outlet temperatures of the evaporator where refrigerant flows through the main circuit and adjusts the refrigerant flow rate through the bypass circuit so that the temperature difference between the inlet and outlet of the evaporator is such that the heat exchange performance is improved. (See, for example, Patent Document 1).

PRIOR ART DOCUMENTS

Patent Document

[Patent Document 1] Japanese Unexamined Patent Application Publication No. 2004-44883

SUMMARY OF THE INVENTION

Problems to be Solved by the Invention

However, since the use of non-azeotropic mixed refrigerant creates a temperature difference in a flow direction of the refrigerant within the evaporator, a low evaporator temperature may result in uneven frost formation on an evaporator surface. Since the above patent document does not address these uneven frost issues, the uneven frost formation on the evaporator surface cannot be adequately suppressed.

The purpose of the present disclosure is to solve the above problems and to provide a refrigeration cycle device that can suppress the uneven frost formation on the evaporator and prevent the heat exchange performance from deteriorating.

Means for Solving Problem

The refrigeration cycle device, according to the present disclosure, with a main circuit in which a compressor, a condenser, a supercooling heat exchanger, a main expansion valve, and an evaporator are connected by refrigerant piping to circulate a non-azeotropic mixed refrigerant, and a bypass circuit branched from between the condenser and the evaporator to be connected to a refrigerant inflow side of the compressor, the bypass circuit including a bypass expansion valve to introduce the non-azeotropic mixed refrigerant from the main circuit, the supercooling heat exchanger exchanging heat between the non-azeotropic mixed refrigerant flowing through the main circuit and the non-azeotropic mixed refrigerant flowing through the bypass circuit, the refrigeration cycle device includes: a controller to control an opening degree of the bypass expansion valve; a first sensor to detect a temperature at the refrigerant inflow side of the evaporator; and a second sensor to detect a pressure of the non-azeotropic mixed refrigerant flowing from the evaporator, wherein the controller controls the opening degree of the bypass expansion valve using the temperature at the refrigerant inflow side of the evaporator detected by the first sensor and a saturated gas temperature of the non-azeotropic mixed refrigerant calculated from the pressure detected by the second sensor and adjusts a flow rate of the non-azeotropic mixed refrigerant flowing into the evaporator.

Effects of the Invention

According to the present disclosure, the temperature difference in the flow direction within the evaporator can be eliminated and thus the uneven frost formation on the evaporator is suppressed, so that the heat exchange performance is prevented from deteriorating.

EMBODIMENTS FOR CARRYING OUT THE INVENTION

The embodiments will be described below with reference to the figures. Note that the dimensions of each configuration shown in the figures may differ from the actual ones. The following description is illustrative, and the forms described in the specification are not limiting.

Embodiment 1

Figure 1:
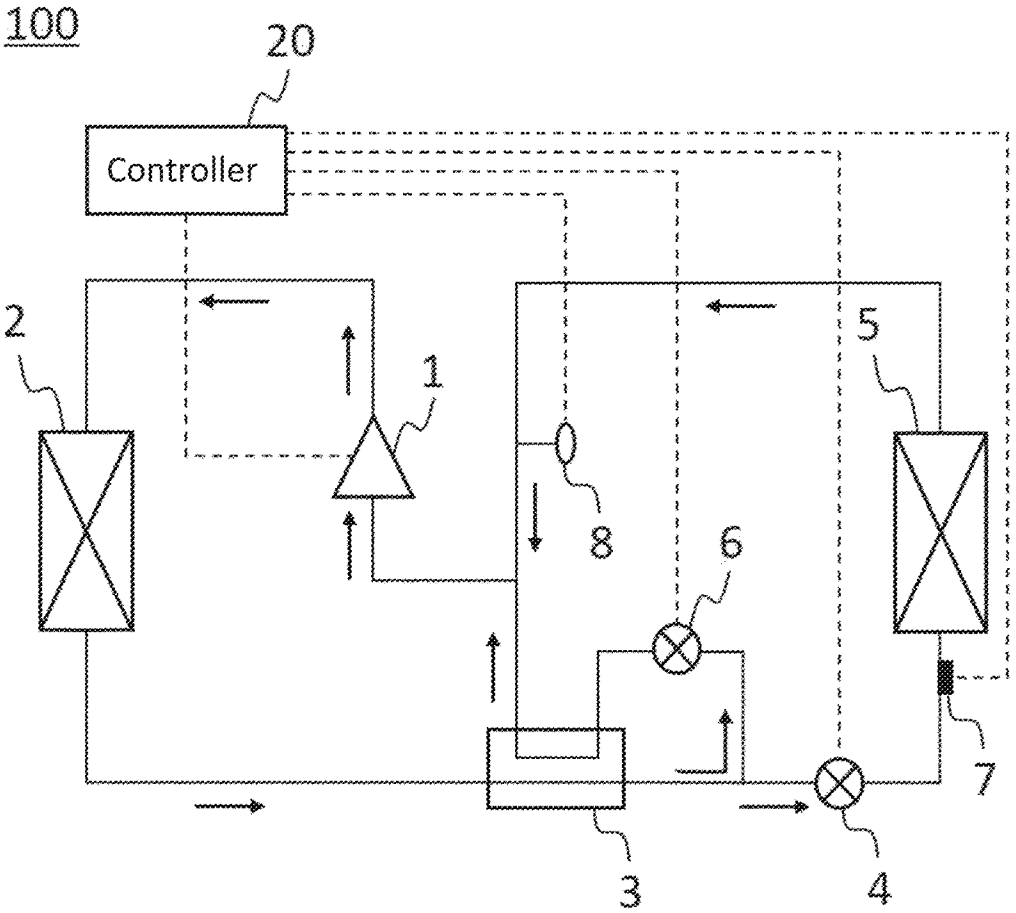
FIG. 1 is a schematic configuration diagram showing a refrigeration cycle device according to Embodiment 1.

FIG. 1 is a schematic configuration diagram showing a refrigeration cycle device 100 according to Embodiment 1. The refrigeration cycle device 100 includes a main circuit and a bypass circuit, through each of which a non-azeotropic mixed refrigerant is circulated. The refrigeration cycle device 100 further includes a controller 20 for controlling operations of a compressor 1, a first heat exchanger 2, a supercooling heat exchanger 3, a first expansion valve 4, a second heat exchanger 5, and a bypass expansion valve 6, etc.

As used herein, the term non-azeotropic mixed refrigerant means a refrigerant which includes, at least in part, any one of the following refrigerants: an olefin refrigerant such as tetrafluoropropene (HFO1234yf) and trifluoroethylene (HFO1123); an ether refrigerant such as dimethyl ether; a hydrocarbon refrigerant such as propane (HC290) and isobutane (HC600a); an ethane refrigerant such as tetrafluoroethane (HFC134a) and pentafluoroethane (HFC125); a methane refrigerant such as difluoromethane (HFC32); and a refrigerant having a lower gas density than difluoromethane. "Olefin" means that the refrigerant contains a carbon-carbon double bond in its composition. "Ether" means that the refrigerant contains an ether bond in its composition. "Hydrocarbon" means that the refrigerant contains both carbon and hydrogen in its composition. "Ethane" means that the refrigerant contains ethane in its composition, and "methane" means that the refrigerant contains methane in its composition. In the following description, the non-azeotropic mixed refrigerant is simply referred to as refrigerant.

The main circuit of the refrigeration cycle device 100 includes the compressor 1, the first heat exchanger 2, the supercooling heat exchanger 3, the first expansion valve 4, and the second heat exchanger 5. The compressor 1, the first heat exchanger 2, the supercooling heat exchanger 3, the first expansion valve 4, and the second heat exchanger 5, which constitute the main circuit, are each connected by refrigerant piping. In the following description, the flow direction of the refrigerant in the present embodiment (the direction indicated by arrows in FIG. 1) is referred to as a first direction. In the main circuit and the bypass circuit according to the present embodiment, when the refrigerant is flowing in the first direction, the refrigerant inflow side is the side from which the refrigerant comes in, and the refrigerant outflow side is the side to which the refrigerant goes out.

Next, each of the components of the main circuit will be described. The compressor 1 sucks in the refrigerant from the refrigerant inflow side to compress it and discharge it from the refrigerant outflow side as a single phase gas at high temperature and pressure. The compressor 1 is configured so that its revolving speed can be controlled by, for example, an inverter circuit and the discharge rate of the refrigerant can be adjusted. The operation of the compressor 1 is controlled on the basis of a control signal from the controller 20.

In the present embodiment, the first heat exchanger 2 functions as a condenser. The refrigerant in the gas single phase at high temperature and high pressure due to the compression of the compressor 1 flows from the refrigerant inflow side into the first heat exchanger 2 to be cooled by the heat exchange with a heat source into a liquid state of low temperature and high pressure. Then, the refrigerant in the liquid state is then discharged from the refrigerant outflow side of the first heat exchanger 2. The heat sources for the first heat exchanger 2 are air (outdoor air), water, antifreeze, etc. The refrigerant flowing through the first heat exchanger 2 exchanges heat with the outdoor air, for example. In order to prompt the heat exchange of the first heat exchanger 2, the refrigeration cycle device 100 may include a blower (not illustrated) that blows the outdoor air to the first heat exchanger 2 while the refrigerant circulates within the refrigeration cycle device 100. The air flow of the blower should be adjustable.

The supercooling heat exchanger 3 is a heat exchanger in which the refrigerant flowing through multiple refrigerant circuits inserted in the supercooling heat exchanger 3 exchanges heat with each other. In the present embodiment, the multiple refrigerant circuits are the main circuit and the bypass circuit. The supercooling heat exchanger 3 cools pre-decompressed liquid refrigerant flowing through the main circuit by using post-decompressed refrigerant in the gas-liquid two-phase state flowing through the bypass circuit. The pre-decompressed refrigerant flowing through the main circuit and the post-decompressed refrigerant flowing through the bypass circuit can exchange heat because their temperatures are different due to the pressure difference. The inflow of the refrigerant into the supercooling heat exchanger 3 through the bypass circuit reduces the refrigerant flow rate into the second heat exchanger 5. However, the increase in the enthalpy difference of the refrigerant before and after the second heat exchanger 5 cancels out the reduction of the heat exchange amount due to the decrease in the refrigerant flow rate, so that the heat exchange amount in the second heat exchanger 5 can be maintained.

The first expansion valve 4, into which the liquid refrigerant cooled to low temperature and high pressure by the first heat exchanger 2 flows, decompresses and expands the refrigerant into a liquid or gas-liquid two-phase state refrigerant of low temperature and low pressure. The first expansion valve 4 is a main expansion valve (a main pressure reducing device), which includes a refrigerant flow rate control means such as an electronic expansion valve and a temperature-sensitive expansion valve, and a capillary tube, for example. The operation of the first expansion valve 4 is controlled on the basis of a control signal from the controller 20.

In the present embodiment, the second heat exchanger 5 functions as an evaporator. The second heat exchanger 5 is, for example, a plate fin tube heat exchanger with multiple heat transfer tubes, multiple fins, a refrigerant manifold, and a header. From the refrigerant inflow side, the liquid or gas-liquid two-phase state refrigerant of low temperature and low pressure, decompressed and expanded by the first expansion valve 4, flows into the second heat exchanger 5. In the second heat exchanger 5, the refrigerant exchanges heat with a cooling target to absorb heat and cool it. Here, the refrigerant evaporates and becomes a low pressure single phase gas while cooling the target. The refrigerant in the gas single phase is discharged from the refrigerant outflow side. The cooling target is, for example, indoor air. That is, the second heat exchanger 5 exchanges heat between the indoor air and the refrigerant. In order to prompt the heat exchange of the second heat exchanger 5, the refrigeration cycle device 100 may include a blower (not illustrated) that blows the indoor air to the second heat exchanger 5 while the refrigerant circulates within the refrigeration cycle device 100. The air flow of the blower should be adjustable.

The second heat exchanger 5 (evaporator) is designed to cause a pressure loss in the refrigerant such that, at a given refrigerant flow rate, the difference between a temperature at the refrigerant inflow side and a saturated gas temperature at the refrigerant outflow side is less than a set temperature difference in the second heat exchanger 5. The temperature at the refrigerant inflow side of the evaporator means a temperature at an inlet of the evaporator or a refrigerant temperature at the refrigerant inflow side. The pressure loss in the second heat exchanger 5 can be adjusted, for example, by changing the number of refrigerant channels (number of passes) or the refrigerant channel diameter in the second heat exchanger 5. The set temperature difference mentioned above is, for example, two degrees C. This temperature setting is based on the known fact that the uneven frost formation is unlikely to occur if the difference between the inflow side and the outflow side temperatures in the second heat exchanger 5 is less than two degrees C.

Meanwhile, in the refrigeration cycle device 100 including the non-azeotropic mixed refrigerant described above, for example under a constant pressure, the temperature of the refrigerant within the second heat exchanger 5 increases as the refrigerant moves toward the flow direction. For example, if R407C (a mixture of HFC134a, HFC125 and HFC32 refrigerant) is used as the refrigerant, at a saturated gas temperature of five degrees C., a temperature gradient of more than six degrees C. may occur within the second heat exchanger 5. In the refrigeration cycle device 100, the greater the temperature gradient of the circulating refrigerant, for example, three degrees C. or greater, the more likely the uneven frost formation occurs in the second heat exchanger 5.

On the other hand, in general, as the pressure decreases, the temperature of the refrigerant also decreases. That is to say, even in the refrigeration cycle device 100 including the non-azeotropic mixed refrigerant, the adjustment of the pressure loss amount of the refrigerant within the second heat exchanger 5 reduces the temperature change of the refrigerant during evaporation, thereby eliminating the temperature difference in the flow direction within the second heat exchanger 5, which in turn enables the suppression of the uneven frost formation in the second heat exchanger 5, i.e., in the evaporator.

Next, the flow of the refrigerant circulating through the main circuit will be described. First, the refrigerant flowing out of the compressor 1 flows into the first heat exchanger 2 (condenser). The refrigerant that flows into the first heat exchanger 2, for example, exchanges heat with a medium to be heated such as the air and then condenses. The refrigerant then flows from the first heat exchanger 2 into the supercooling heat exchanger 3. The refrigerant flowing into the supercooling heat exchanger 3 is cooled by the refrigerant circulating in the bypass circuit.

The refrigerant flowing from the supercooling heat exchanger 3 is divided into refrigerant flowing through the main circuit and refrigerant flowing through the bypass circuit. The refrigerant flowing through the main circuit after the split will be described. First, the refrigerant flows from the supercooling heat exchanger 3 to the first expansion valve 4, where it is decompressed and then flows to the second heat exchanger 5 (evaporator). The refrigerant flows into the second heat exchanger 5 and exchanges heat with a medium to be cooled and evaporates. The evaporated refrigerant is sucked in by the compressor 1 and compressed. When the bypass expansion valve 6 is fully closed, the refrigerant will not flow into the bypass circuit.

The bypass circuit will be described. The bypass circuit has an inlet and an outlet and is connected to the main circuit through the inlet and outlet. As shown in FIG. 1, the inlet is located between the refrigerant outflow side of the first heat exchanger 2 and the refrigerant inflow side of the second heat exchanger 5. The outlet is located between the refrigerant outflow side of the second heat exchanger 5 and the refrigerant inflow side of the compressor 1. The bypass circuit includes the bypass expansion valve 6 between its inlet and outlet. When the bypass expansion valve 6 is opened, the refrigerant diverted from the main circuit is introduced into the bypass circuit. Here, the behavior of the bypass expansion valve 6, i.e., the degree to which the bypass expansion valve 6 is opened, is controlled on the basis of the control signal from the controller 20.

Like the first expansion valve 4, the bypass expansion valve 6 decompresses and expands the refrigerant to a liquid or gas-liquid two-phase state of low temperature and low pressure. The refrigerant piping in the bypass circuit is configured such that the refrigerant circulating in the bypass circuit also circulates to the supercooling heat exchanger 3.

That is, the refrigerant to be circulated through the bypass circuit flows in from its inlet, is decompressed by the bypass expansion valve 6, and then flows into the supercooling heat exchanger 3. In the supercooling heat exchanger 3, the refrigerant exchanges heat with the refrigerant flowing through the main circuit, and then flows out of the supercooling heat exchanger 3. The refrigerant flowing out of the outlet of the supercooling heat exchanger 3 in the bypass circuit is mixed with the refrigerant from the main circuit and sucked in by the compressor 1. The refrigerant flowing into the bypass expansion valve 6 cools the refrigerant before the diversion, i.e., the refrigerant flowing through the main circuit and evaporates.

The pressure reduction by the bypass expansion valve 6 makes the refrigerant flowing through the bypass circuit cooler than the high-pressure side refrigerant flowing through the supercooling heat exchanger 3. Thus, the refrigerant flowing through the bypass circuit can cool the refrigerant flowing through the main circuit via the supercooling heat exchanger 3. The circulation of the refrigerant in the bypass circuit reduces the refrigerant flow rate into the second heat exchanger 5, but does not reduce the heat exchange amount in the second heat exchanger 5 due to the decrease in the enthalpy of the refrigerant flowing into the second heat exchanger 5. On the other hand, the decrease in the refrigerant flow rate into the second heat exchanger 5 reduces the pressure loss in the second heat exchanger 5. An increase in the opening degree of the bypass expansion valve 6 causes an increase in the heat exchange amount in the supercooling heat exchanger 3 and a decrease in the refrigerant flow rate into the second heat exchanger 5. That is, the pressure loss in the second heat exchanger 5 can be adjusted while ensuring the heat exchange amount by controlling the opening degree of the bypass expansion valve 6 by the controller 20.

As shown in FIG. 1, the inlet of the bypass circuit should be located between the refrigerant outflow side of the supercooling heat exchanger 3 and the refrigerant inflow side of the first expansion valve 4. The refrigerant circulating through the main circuit is in a liquid state when it flows out after the heat exchange between the refrigerants. On the other hand, the refrigerant decompressed by the first expansion valve 4 may be in a gas-liquid two-phase state. In adjusting the opening degree of the bypass expansion valve 6 and thus the flow rates of the refrigerant circulating separately through the main circuit and the bypass circuit, the location of the inlet of the bypass circuit between the refrigerant outflow side of the supercooling heat exchanger 3 and the refrigerant inflow side of the first expansion valve 4 as described above allows the refrigerant to be divided in the liquid state and facilitates the management of the flow rates of the refrigerants circulating separately through the main circuit and the bypass circuit.

By locating the inlet between the refrigerant outflow side of the supercooling heat exchanger 3 and the refrigerant inflow side of the first expansion valve, the heat exchange performance of the supercooling heat exchanger 3 can be improved without complex refrigerant piping, because the refrigerants circulating through the main circuit and the refrigerant circulating through the bypass circuit flow in opposite directions within the supercooling heat exchanger 3.

The controller 20 of the Refrigeration cycle device 100 will be described. The controller 20 controls the revolving speed of the compressor 1 and thus adjusts the refrigerant flow rate from the compressor 1. In addition, the controller 20 controls the first expansion valve 4 and the bypass expansion valve 6 to adjust their respective opening degrees. The controller 20 also controls the opening degree of the bypass expansion valve 6 using sensor information obtained from a first sensor 7 and a second sensor, which will be described next.

The first sensor 7 and the second sensor 8 are included in the refrigeration cycle device 100. The first sensor 7, which is a temperature sensor, is located at the refrigerant inflow side of the second heat exchanger 5 to obtain the temperature of the inflowing refrigerant, for example, as shown in FIG. 1. The second sensor 8, which is a pressure sensor, is located between the refrigerant outflow side of the second heat exchanger 5 and the refrigerant inflow side of the compressor 1 to obtain the pressure of the refrigerant in the gas single phase at the refrigerant outflow side of the second heat exchanger 5, for example, as shown in FIG. 1. Then, the controller 20 obtains the pressure of the refrigerant at the refrigerant outflow side of the second heat exchanger 5 from the second sensor 8 and calculates the saturated gas temperature at the refrigerant outflow side of the second heat exchanger 5 on the basis of, for example, the data stored in a memory (not illustrated) included in the controller 20, in which the pressure of the refrigerant and the saturated gas temperature are associated with each other.

The second sensor 8 measuring the pressure of the refrigerant should preferably be located between the refrigerant outflow side of the second heat exchanger 5 and the bypass circuit. This is because, in the refrigeration cycle device 100 in which the non-azeotropic mixed refrigerant is used, the system for obtaining the pressure of the refrigerant and converting it to a temperature allows accurate measurement of the temperature of a location where the uneven frost formation may occur in the second heat exchanger 5, as described next.

Figure 2:
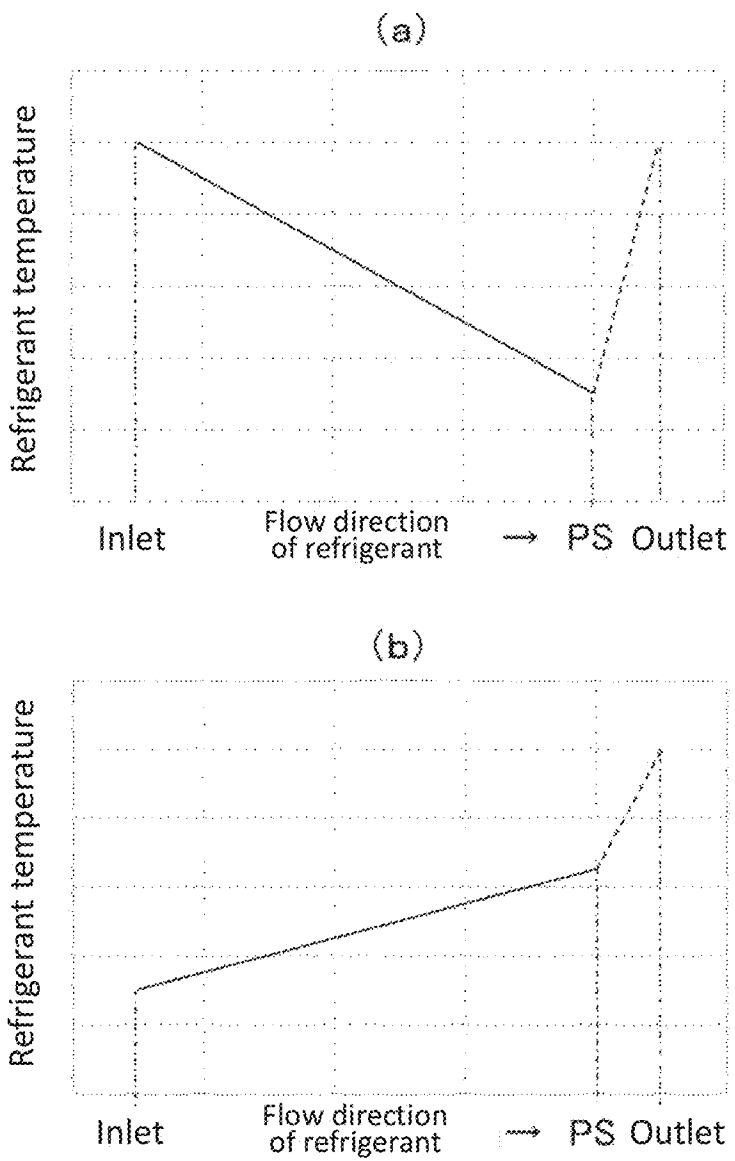
FIG. 2 is an explanatory diagram showing an example of temperature distribution of refrigerant within an evaporator according to Embodiment 1.

FIG. 2 is an explanatory diagram showing an example of temperature distribution of refrigerant within the evaporator according to Embodiment 1. In each of FIG. 2(*a*) and FIG. 2(*b*), the vertical axis represents the temperature of the refrigerant in the evaporator and the horizontal axis represents the position of the refrigerant in the flow direction in the evaporator. Thus, in FIGS. 2(*a*) and 2(*b*), the evaporator inlet is on the left and its outlet is on the right. In each of FIGS. 2(*a*) and 2(*b*), the solid line indicates that the refrigerant is in the gas-liquid two-phase state, the point PS indicates that the refrigerant is in the saturated gas state, and the dashed line indicates that the refrigerant is in the gas single phase state.

The non-azeotropic mixed refrigerant changes its state in the evaporator to the saturated gas state via the gas-liquid two-phase state. When the refrigerant is in the gas-liquid two-phase state, the heat absorbed from the environment is used to raise the temperature as well as to change the phase. In some cases, this causes the temperature in the evaporator to decrease, as shown by the solid line in FIG. 2(*a*). In other cases, it causes the temperature in the evaporator to rise gradually, as shown by the solid line in FIG. 2(*b*).

On the other hand, the refrigerant in the gas single phase, which has passed through the saturated gas state, immediately increases its temperature because it uses the heat absorbed from the environment only for increasing its temperature as shown by the dashed lines in FIGS. 2(*a*) and 2(*b*). In this case, directly obtaining the temperature at the refrigerant outflow side of the evaporator as is means obtaining the refrigerant temperature that has already reached a high level. Therefore, it may not be possible to obtain the valid difference between the temperature at the refrigerant inflow side and the temperature at the refrigerant outflow side in the evaporator.

This means that the controller 20 cannot perform a control to suppress the uneven frost formation even though there is a low-temperature location, i.e., a location where the uneven frost formation may occur, within the evaporator, as shown in FIG. 2(*a*), for example.

However, the saturated gas temperature can be calculated from the pressure of the refrigerant flowing out of the evaporator as measured by the second sensor 8. This gives the temperature at a point where all of the refrigerants included in the non-azeotropic mixed refrigerant have evaporated, i.e., the temperature at the end point PS of the solid line in each of FIGS. 2(*a*) and 2(*b*). This makes it possible to obtain the temperature at the refrigerant outflow side in the evaporator and the exact difference between the temperature at the refrigerant inflow side and the temperature at the refrigerant outflow side in the evaporator, thereby enabling the controller 20 to suppress the uneven frost formation. Next, the control by means of the controller 20 will be described.

In the following, for simplicity of the description, the refrigerant temperature at the refrigerant inflow side of the second heat exchanger 5 is simply referred to as the refrigerant temperature, and the saturated gas temperature at the refrigerant outflow side of the second heat exchanger 5 is simply referred to as the saturated gas temperature. On the basis of the sensor information obtained from the first sensor 7 and the second sensor 8, the controller 20 controls the opening degree of the bypass expansion valve 6 to adjust the refrigerant flow rate into the second heat exchanger 5 (evaporator). The operation of the controller 20 will be described below, along with examples of the operation state of the refrigeration cycle device 100 according to the present embodiment. The operation of the controller 20, to be described next, is performed when the refrigerant temperature or the saturated gas temperature falls below a set temperature to suppress the uneven frost formation at the refrigerant inflow side or the refrigerant outflow side of the evaporator. The set temperature above is two degrees C., for example. This setting temperature is based on the knowledge that the uneven frost formation may occur if the refrigerant temperature or the saturated gas temperature of the second heat exchanger 5 falls below two degrees C.

Figure 3:
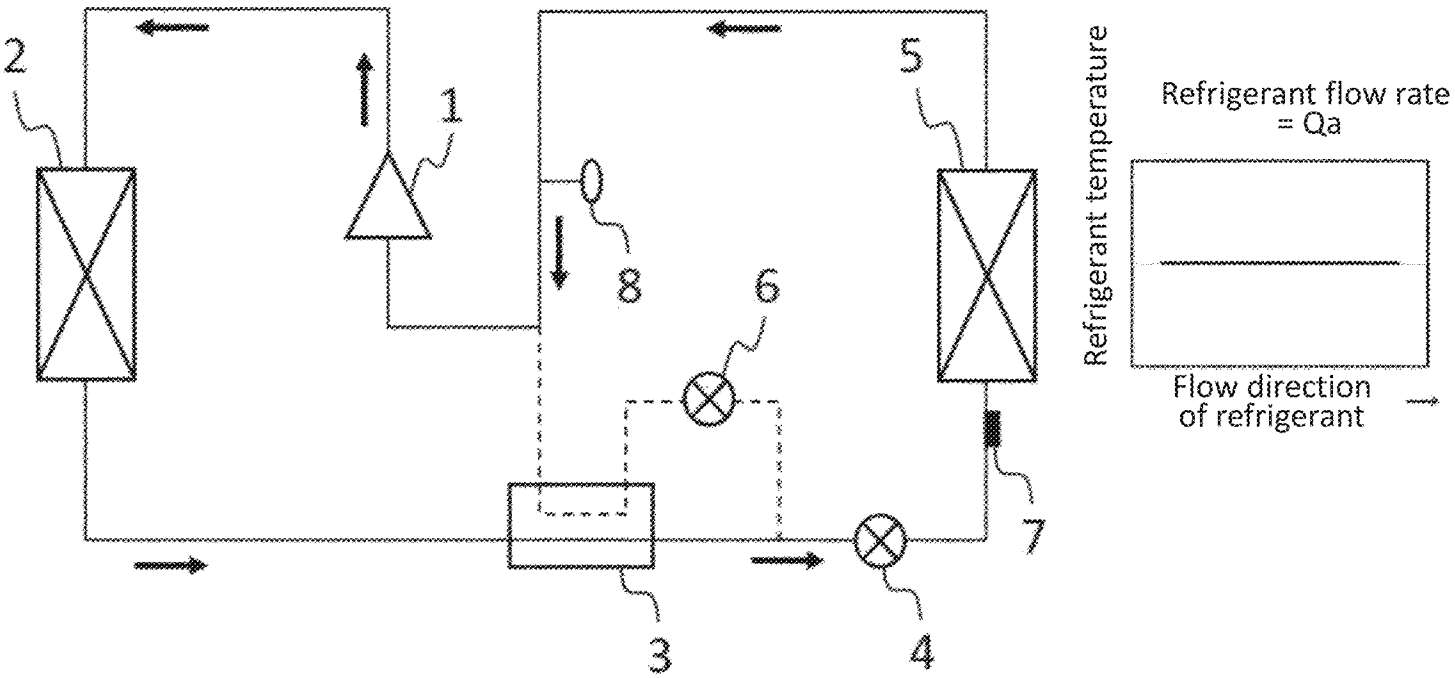
FIG. 3 is an explanatory diagram showing the first example of an operation state of the refrigeration cycle device according to Embodiment 1.

First, the first example of the operation state of the refrigeration cycle device 100 will be described. FIG. 3 is an explanatory diagram showing the first example of the operation state of the refrigeration cycle device 100 according to Embodiment 1. In FIG. 3, the graph on the right side is a graph that schematically shows the temperature of the refrigerant flowing in the evaporator. The vertical axis of the graph represents the refrigerant temperature, and the horizontal axis represents the position of the refrigerant in the flow direction in the evaporator. That is, the refrigerant inflow side of the evaporator is the left side of the graph, and the refrigerant outflow side of the evaporator is the right side of the graph. The same is true for the graphs shown in FIGS. 4 through 8 and FIGS. 13 through 18 below.

In the first example shown in FIG. 3, the refrigerant flow rate from the compressor 1 is Qa, and the second heat exchanger 5 is designed such that the difference between the temperature at the refrigerant inflow side and the saturated gas temperature is less than two degrees C. when the refrigerant flow rate into the second heat exchanger 5 is Qa. In the first example, the bypass expansion valve 6 is fully closed and the refrigerant flow rate into the second heat exchanger 5 is Qa, so that the difference between the temperature at the refrigerant inflow side and the saturated gas temperature in the second heat exchanger 5 is less than two degrees C. Therefore, in the first example, the uneven frost formation on the surface of the second heat exchanger 5, i.e., the evaporator, is suppressed.

Figure 4:
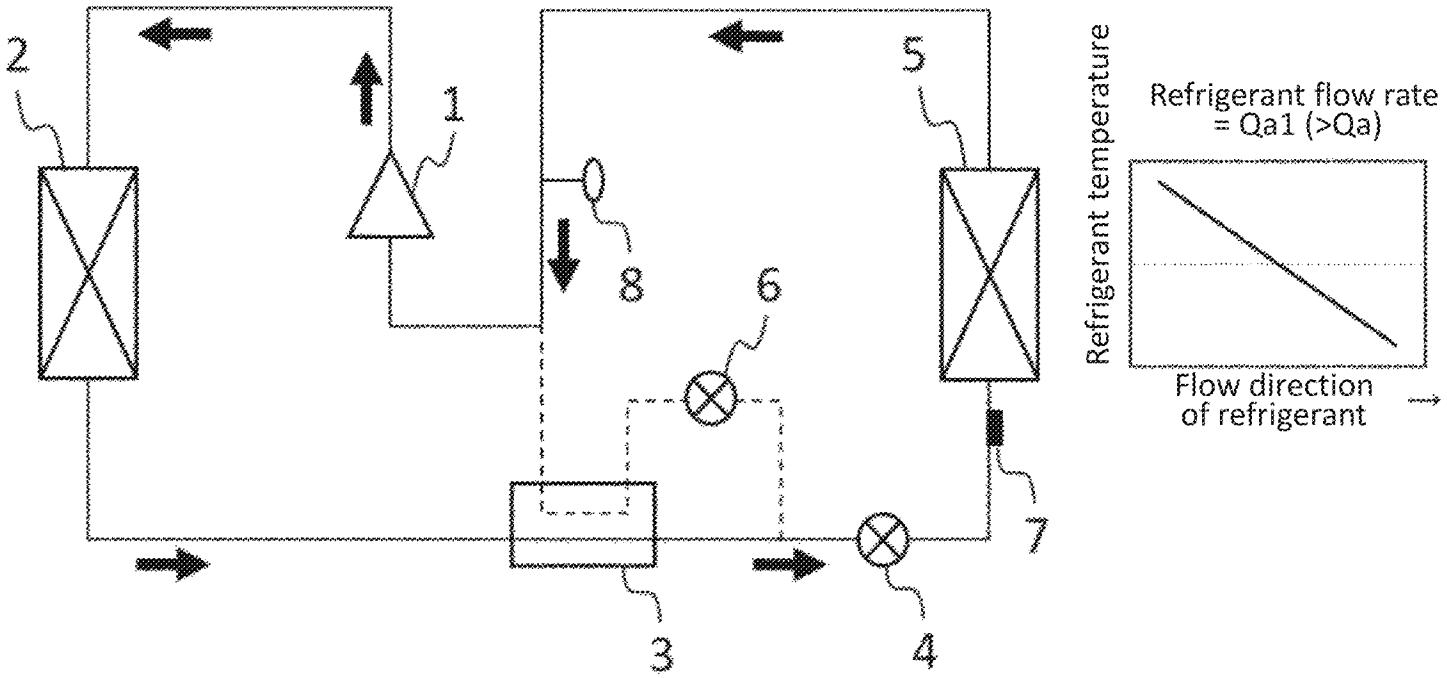
FIG. 4 is an explanatory diagram showing the second example of the operation state of the refrigeration cycle device according to Embodiment 1.

Next, the second example of the operation state of the refrigeration cycle device 100 will be described. FIG. 4 is an explanatory diagram showing the second example of the operation state of the refrigeration cycle device 100 according to Embodiment 1. FIG. 4 shows an example in which the refrigerant flow rate from the compressor 1 is Qa1, which is greater than Qa, and the bypass expansion valve 6 is fully closed. In this case, since the refrigerant flow rate into the second heat exchanger 5 is also Qa1, the pressure loss of the refrigerant within the second heat exchanger 5 is larger compared to when the refrigerant flow rate into the second heat exchanger 5 is Qa. This causes the saturated gas temperature at the refrigerant outflow side to be lower than the temperature at the refrigerant inflow side in the second heat exchanger 5, so that the uneven frost formation may occur at the refrigerant outflow side in the second heat exchanger 5. On the other hand, in the third example of the operation state of the refrigeration cycle device 100 described next, the uneven frost formation on the second heat exchanger 5 is suppressed by opening the bypass expansion valve 6.

Figure 5:
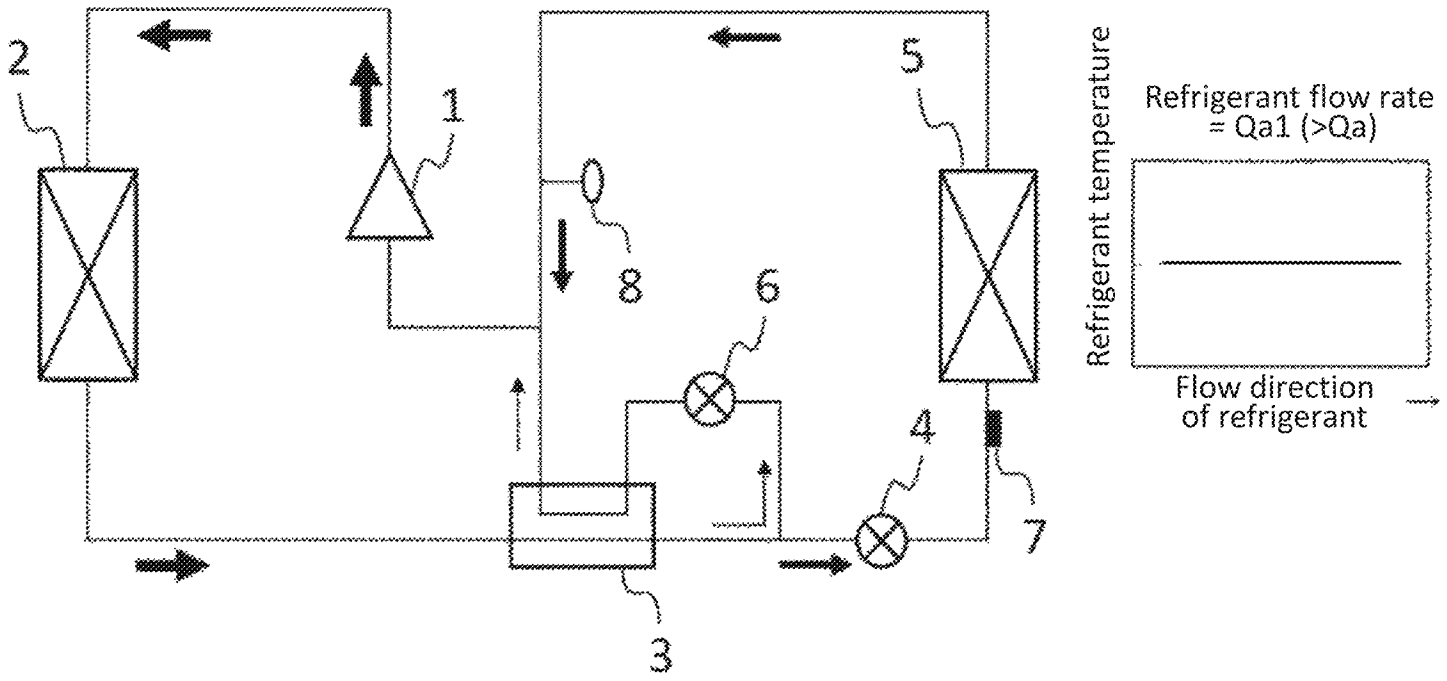
FIG. 5 is an explanatory diagram showing the third example of the operation state of the refrigeration cycle device according to Embodiment 1.

FIG. 5 is an explanatory diagram showing the third example of the operation state of the refrigeration cycle device 100 according to Embodiment 1. FIG. 5 shows an example in which the bypass expansion valve 6 is in an open state and the refrigerant flow rate from the compressor 1 is Qa1, which is the same as that in the second example. The controller 20 calculates the refrigerant temperature and the saturated gas temperature of the second heat exchanger 5 using the sensor information obtained from the first sensor 7 and the second sensor 8, respectively. The controller 20 compares the refrigerant temperature and the saturated gas temperature when the difference between the refrigerant temperature and the saturated gas temperature in the second heat exchanger 5 is equal to or greater than the set temperature difference. When the saturated gas temperature is lower than the refrigerant temperature, the controller 20 opens the bypass expansion valve 6 to reduce the refrigerant flow rate through the main circuit. The reduction of the refrigerant flow rate through the main circuit reduces the refrigerant flow rate into the second heat exchanger 5, so that the pressure loss of the refrigerant in the second heat exchanger 5 is reduced. Therefore, as shown in FIG. 5, the temperature drop at the refrigerant outflow side of the second heat exchanger 5 can be suppressed, and thus the uneven frost formation at the refrigerant outflow side in the second heat exchanger 5, or the evaporator, can be suppressed.

In the above, an example is described in which the second heat exchanger 5 is designed such that, with no refrigerant flowing into the bypass circuit, the difference between the temperature at the refrigerant inflow side and the saturated gas temperature at the refrigerant outflow side in the second heat exchanger 5 is less than the set temperature difference. As an alternative, it is also possible to design the second heat exchanger 5 such that, with the refrigerant being divided and flowing into both the bypass circuit and the main circuit, the difference between the temperature at the refrigerant inflow side and the saturated gas temperature at the refrigerant outflow side in the second heat exchanger 5 is less than the set temperature difference.

Figure 6:
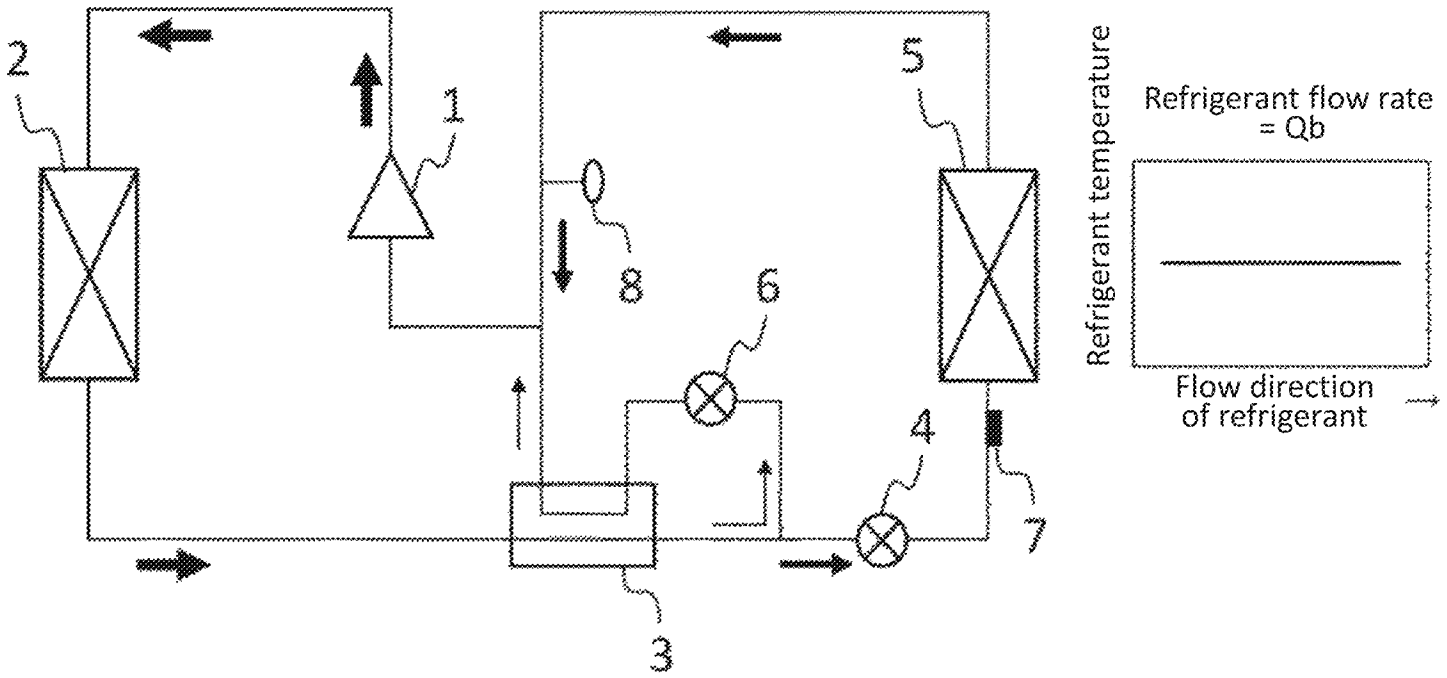
FIG. 6 is an explanatory diagram showing the fourth example of the operation state of the refrigeration cycle device according to Embodiment 1.

FIG. 6 is an explanatory diagram showing the fourth example of the operation state of the refrigeration cycle device 100 according to Embodiment 1. In the fourth example, the second heat exchanger 5 is designed such that, when the refrigerant flow rate from the compressor 1 is Qb1 and the refrigerant flow rate into the second heat exchanger 5 is Qb, which is smaller than Qb1, the difference between the temperature at the refrigerant inflow side and the saturated gas temperature at the refrigerant outflow side is less than two degrees C. In the fourth example, since the bypass expansion valve 6 is in an open state and the refrigerant flow rate into the second heat exchanger 5 is Qb, the temperature difference between the refrigerant inflow side and the refrigerant outflow side in the second heat exchanger 5 is less than two degrees C. Therefore, in the fourth example, the uneven frost formation on the surface of the second heat exchanger 5, or the evaporator, is suppressed. In the fourth example, the refrigerant flow rate into the bypass circuit is Qb1-Qb.

Figure 7:
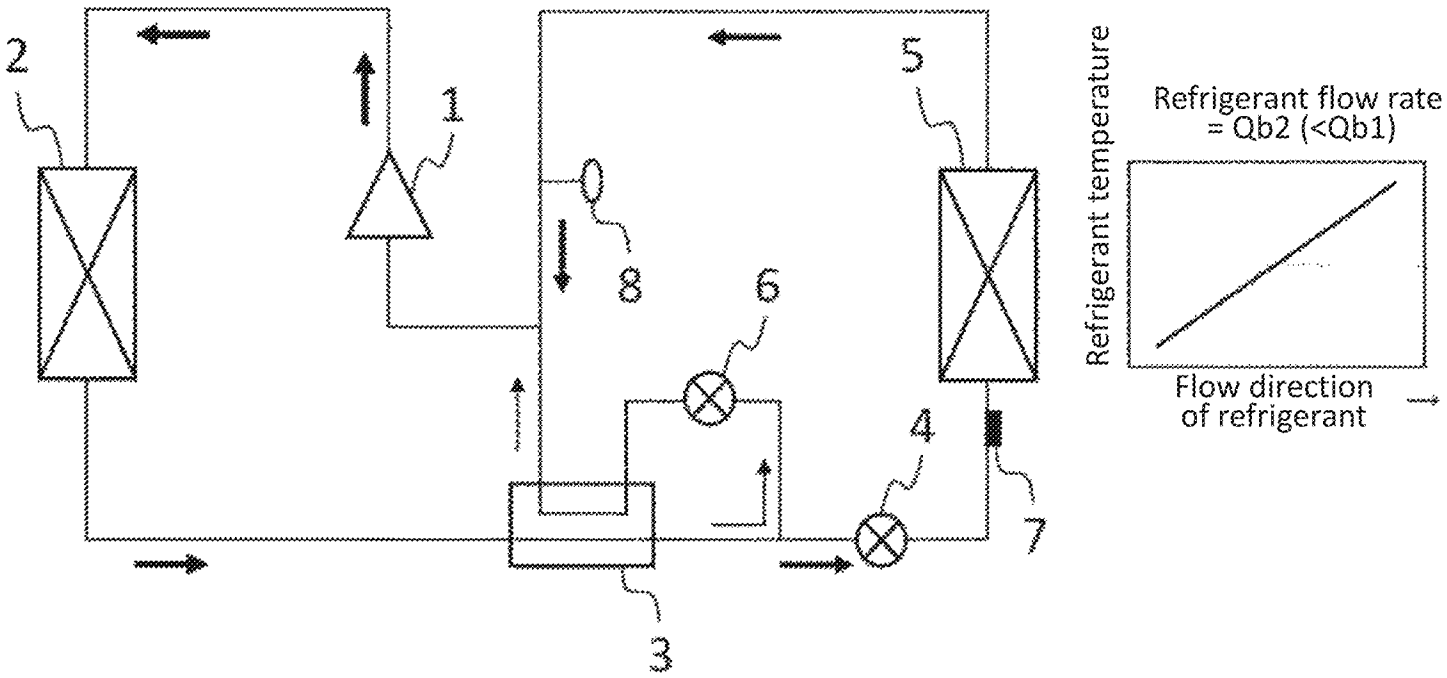
FIG. 7 is an explanatory diagram showing the fifth example of the operation state of the refrigeration cycle device according to Embodiment 1.

Next, the fifth example of the operation state of the refrigeration cycle device 100 will be described. FIG. 7 is an explanatory diagram showing the fifth example of the operation state of the refrigeration cycle device 100 according to Embodiment 1. FIG. 7 shows an example, in which the refrigerant flow rate from the compressor 1 is Qb2, which is smaller than Qb1, and the bypass expansion valve 6 is in an open state. In this case, since the refrigerant flow rate into the second heat exchanger 5 is a value less than Qb, the pressure loss of the refrigerant within the second heat exchanger 5 is lower compared to when the refrigerant flow rate into the second heat exchanger 5 is Qb. This causes the saturated gas temperature to be higher than the refrigerant temperature in the second heat exchanger 5, so that the uneven frost formation may occur at the refrigerant inflow side in the second heat exchanger 5. However, the uneven frost formation on the second heat exchanger 5 is suppressed by closing the bypass expansion valve 6 as shown in the sixth example of the refrigeration cycle device 100 described below.

Figure 8:
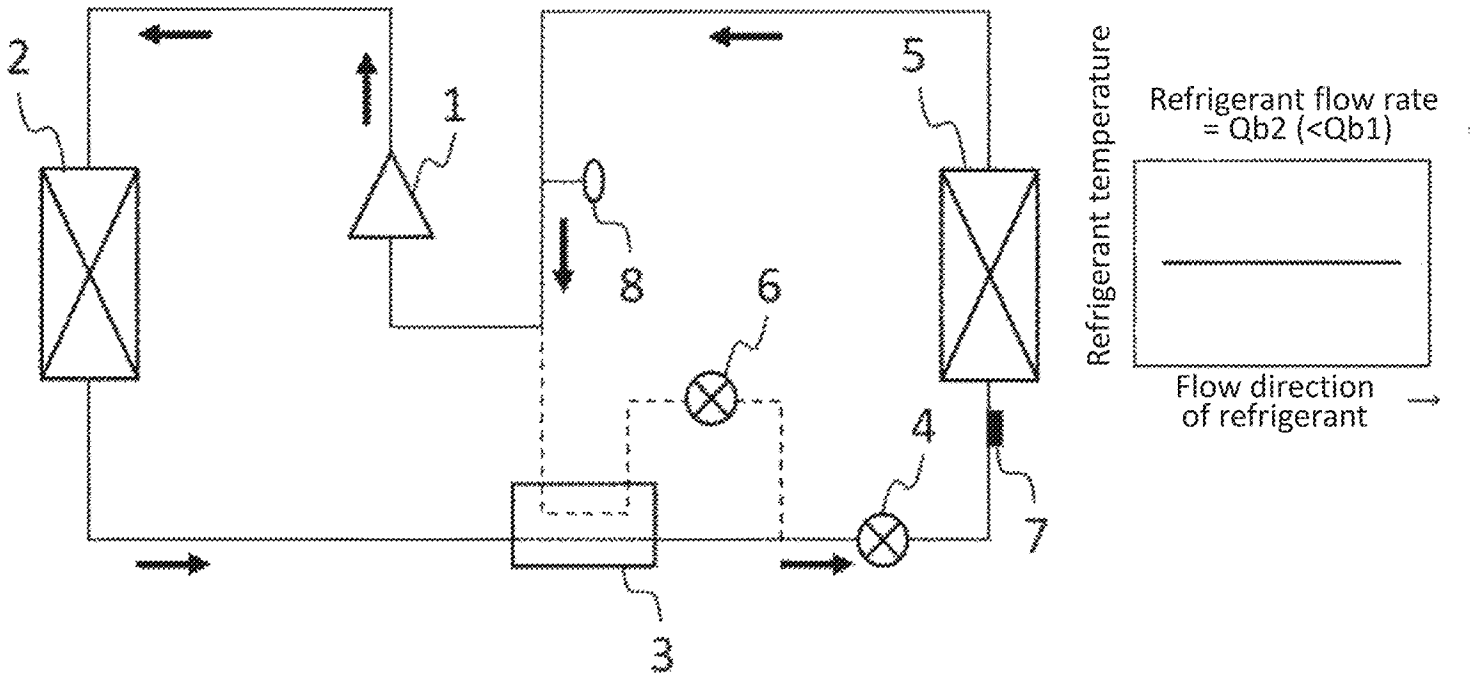
FIG. 8 is an explanatory diagram showing the sixth example of the operation state of the refrigeration cycle device according to Embodiment 1.

FIG. 8 is an explanatory diagram showing the sixth example of the operation state of the refrigeration cycle device 100 according to Embodiment 1. FIG. 8 shows an example, in which the bypass expansion valve 6 is fully closed and the refrigerant flow rate from the compressor 1 is Qb2, which is the same as that in the fifth example. The controller 20 calculates the refrigerant temperature and the saturated gas temperature of the second heat exchanger 5 using the sensor information obtained from the first sensor 7 and the second sensor 8, respectively. The controller 20 compares the refrigerant temperature and the saturated gas temperature when the difference between the refrigerant temperature and the saturated gas temperature in the second heat exchanger 5 is equal to or greater than the set temperature difference. When the refrigerant temperature is lower than the saturated gas temperature, the controller 20 closes the bypass expansion valve 6 to increase the refrigerant flow rate through the main circuit. The increase of the refrigerant flow rate through the main circuit increases the refrigerant flow rate into the second heat exchanger 5, so that the pressure loss of the refrigerant in the second heat exchanger 5 is increased. As shown in FIG. 8, this suppresses the temperature drop at the refrigerant inflow side in the second heat exchanger 5 and thus suppresses the uneven frost formation at the refrigerant inflow side in the second heat exchanger 5, i.e., the evaporator.

Figure 9:
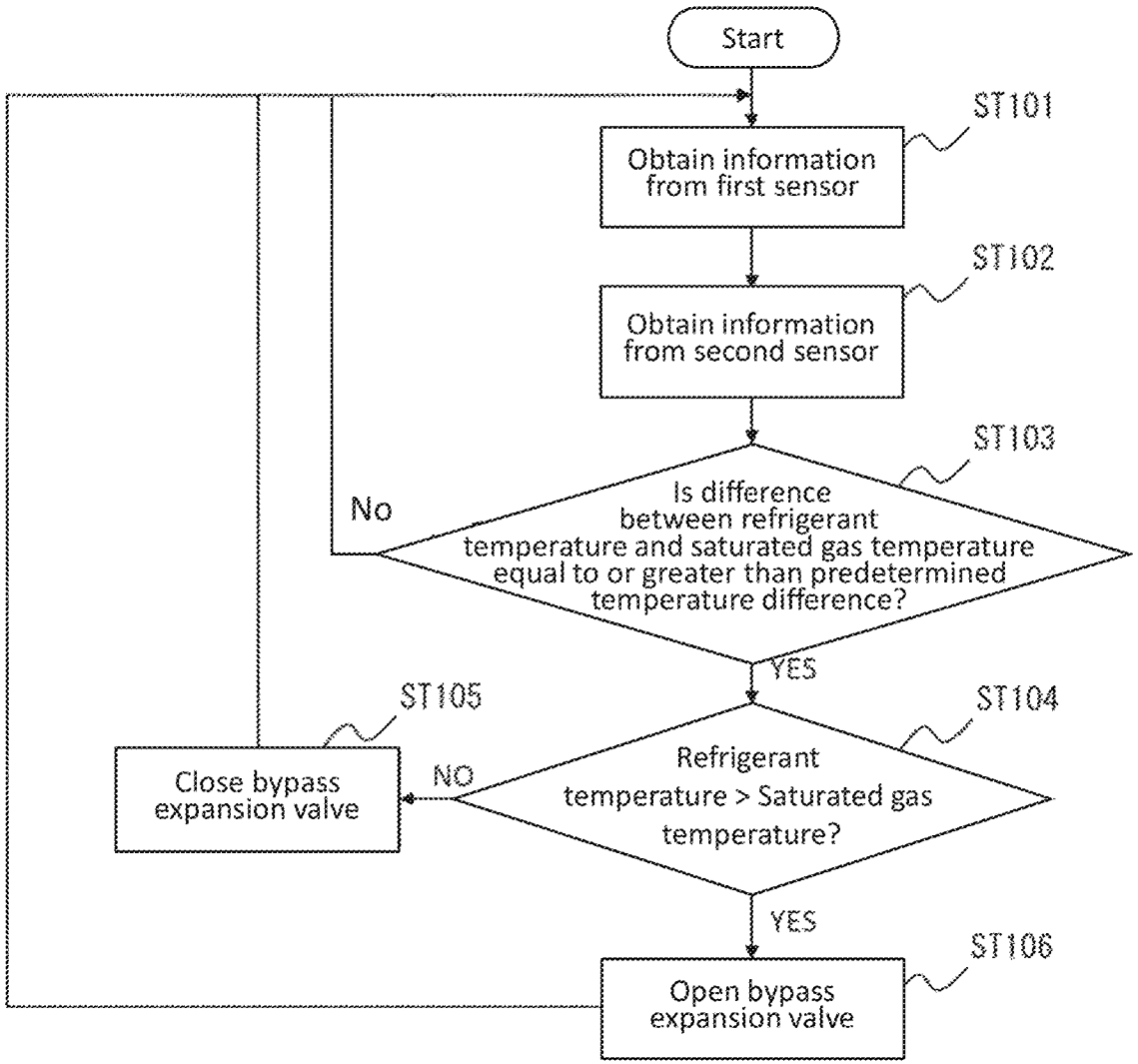
FIG. 9 is a flowchart showing an example of an operation of a controller of the refrigeration cycle device according to Embodiment 1.

A control flow of the controller 20 is shown below. FIG. 9 is a flowchart showing an operation example of the controller 20 of the refrigeration cycle device 100 according to Embodiment 1. Although the flowchart in FIG. 9 does not include a process for terminating the operation of the controller 20, the controller 20 terminates its operation, for example, when it receives a command to terminate its operation from a remote controller (not shown) or the like. First, the controller 20 obtains the sensor information from the first sensor 7 (ST101). The controller 20 obtains the sensor information from the second sensor 8 (ST102). The sensor information obtained from the first sensor 7 and the second sensor 8 is the temperature of the refrigerant and the pressure of the refrigerant, respectively.

Next, the controller 20 compares the refrigerant temperature and the saturated gas temperature using the obtained sensor information to determine whether the difference between the refrigerant temperature and the saturated gas temperature is greater than the set temperature difference (ST103). If the difference between the refrigerant temperature and the saturated gas temperature is less than the set temperature difference (ST103; NO), the operation of the controller 20 proceeds to the processing of ST101.

On the other hand, if the difference between the refrigerant temperature and the saturated gas temperature is greater than or equal to the set temperature difference (ST103; YES), the controller 20 compares the refrigerant temperature and the saturated gas temperature and determines which of the refrigerant temperature and the saturated gas temperature is lower (ST104).

If the saturated gas temperature is lower than the refrigerant temperature (ST104; YES), the controller 20 opens the bypass expansion valve 6 to reduce the refrigerant flow rate through the main circuit. If the saturated gas temperature is lower than the refrigerant temperature, the uneven frost formation may occur at the refrigerant outflow side of the second heat exchanger 5. As shown in the third example of the operation state of the refrigeration cycle device 100, opening the bypass expansion valve 6 reduces the refrigerant flow rate into the second heat exchanger 5, which reduces the pressure loss of the refrigerant within the second heat exchanger 5. Therefore, the temperature drop at the refrigerant outflow side of the second heat exchanger 5 can be suppressed, and thus the uneven frost formation at the refrigerant outflow side of the second heat exchanger 5 can be suppressed. Then, the operation of the controller 20 proceeds to the processing of ST101.

On the other hand, if the refrigerant temperature is lower than the saturated gas temperature (ST104; NO), the controller 20 closes the bypass expansion valve 6 to increase the refrigerant flow rate through the main circuit. If the refrigerant temperature is lower than the saturated gas temperature, the uneven frost formation may occur at the refrigerant outflow side of the second heat exchanger 5. As shown in the sixth example of the operation state of the refrigeration cycle device 100, closing the bypass expansion valve 6 increases the refrigerant flow rate into the second heat exchanger 5, which increases the pressure loss of the refrigerant within the second heat exchanger 5. Therefore, the temperature drop at the refrigerant inflow side of the second heat exchanger 5 can be suppressed, and thus the uneven frost formation at the refrigerant inflow side of the second heat exchanger 5 can be suppressed. Then, the operation of the controller 20 proceeds to the processing of ST101. In the open/close control of the bypass expansion valve 6 by the controller 20 described above, it is possible to adjust the amount by which the bypass expansion valve 6 is opened.

As described above, the adjustment of the refrigerant flow rates through the main circuit and the bypass circuit, enabled by the control of the opening degree of the bypass expansion valve 6, can offset the temperature increase due to the temperature gradient of the refrigerant and the temperature drop due to the pressure loss in the evaporation process of the refrigerant. This reduces the difference between the temperature at the refrigerant inflow side and the temperature at the refrigerant outflow side of the evaporator (the second heat exchanger 5), thus suppressing the uneven frost formation, which results in preventing the heat exchange performance from deteriorating. Furthermore, by controlling the opening degree of the bypass expansion valve 6 and by using the supercooling heat exchanger 3, the refrigerant flow rate into the evaporator can be changed to ensure a certain amount of heat exchange in the evaporator.

Thus, the refrigeration cycle device 100 with a main circuit in which a compressor 1, a condenser, a supercooling heat exchanger 3, a main expansion valve, and an evaporator are connected by refrigerant piping to circulate a non-azeotropic mixed refrigerant, and a bypass circuit branched from between the condenser and the evaporator to be connected to a refrigerant inflow side of the compressor 1, the bypass circuit including a bypass expansion valve 6 to introduce the non-azeotropic mixed refrigerant from the main circuit, the supercooling heat exchanger 3 exchanging heat between the non-azeotropic mixed refrigerant flowing through the main circuit and the non-azeotropic mixed refrigerant flowing through the bypass circuit, the refrigeration cycle device 100 includes: a controller 20 to control an opening degree of the bypass expansion valve 6; a first sensor 7 to detect a temperature at the refrigerant inflow side of the evaporator; and a second sensor 8 to detect a pressure of the non-azeotropic mixed refrigerant flowing from the evaporator, wherein the controller 20 controls the opening degree of the bypass expansion valve 6 using the temperature at the refrigerant inflow side of the evaporator detected by the first sensor 7 and a saturated gas temperature of the non-azeotropic mixed refrigerant calculated from the pressure detected by the second sensor 8 and adjusts a flow rate of the non-azeotropic mixed refrigerant flowing into the evaporator. This eliminates the temperature difference in the flow direction in the evaporator, suppresses uneven frost formation on the evaporator, and thus prevents heat exchange performance from degrading.

Figure 10:
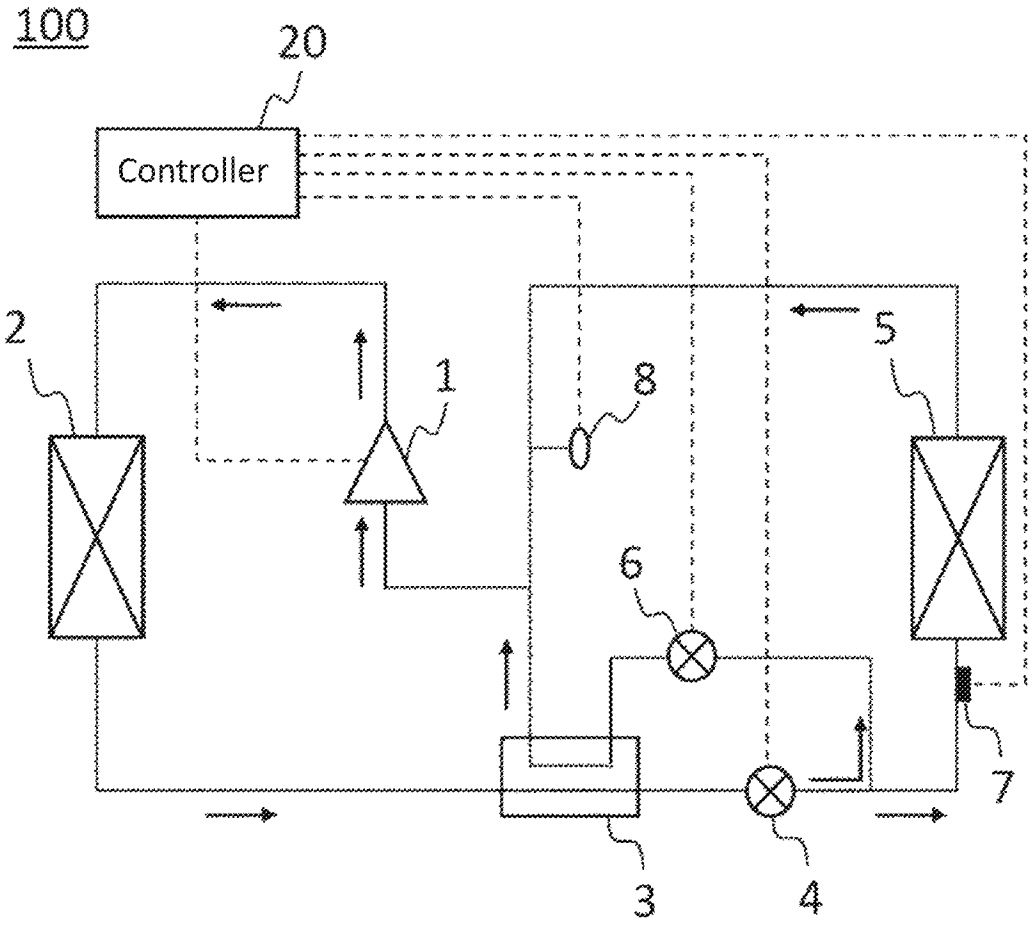
FIG. 10 is a schematic configuration diagram showing the refrigeration cycle device according to Embodiment 1.

Although the present embodiment has shown an example in which the inlet of the bypass circuit is located between the refrigerant outflow side of the supercooling heat exchanger 3 and the refrigerant inflow side of the first expansion valve 4, the requirement for the location of the inlet of the bypass circuit is to be between the refrigerant outflow side of the first heat exchanger 2 and the refrigerant inflow side of the second heat exchanger 5. For example, the inlet of the bypass circuit may be located between the refrigerant outflow side of the first expansion valve 4 and the refrigerant inflow side of the second heat exchanger 5. FIG. 10 is a schematic configuration diagram showing the refrigeration cycle device 100 according to Embodiment 1. As shown in FIG. 10, by locating the inlet of the bypass circuit between the refrigerant outflow side of the first expansion valve 4 and the refrigerant inflow side of the second heat exchanger 5, the heat exchange performance of the supercooling heat exchanger 3 can be improved without complex refrigerant piping, because the refrigerants circulating through the main circuit and the refrigerant circulating through the bypass circuit flow in opposite directions within the supercooling heat exchanger 3.

Embodiment 2

Figure 11:
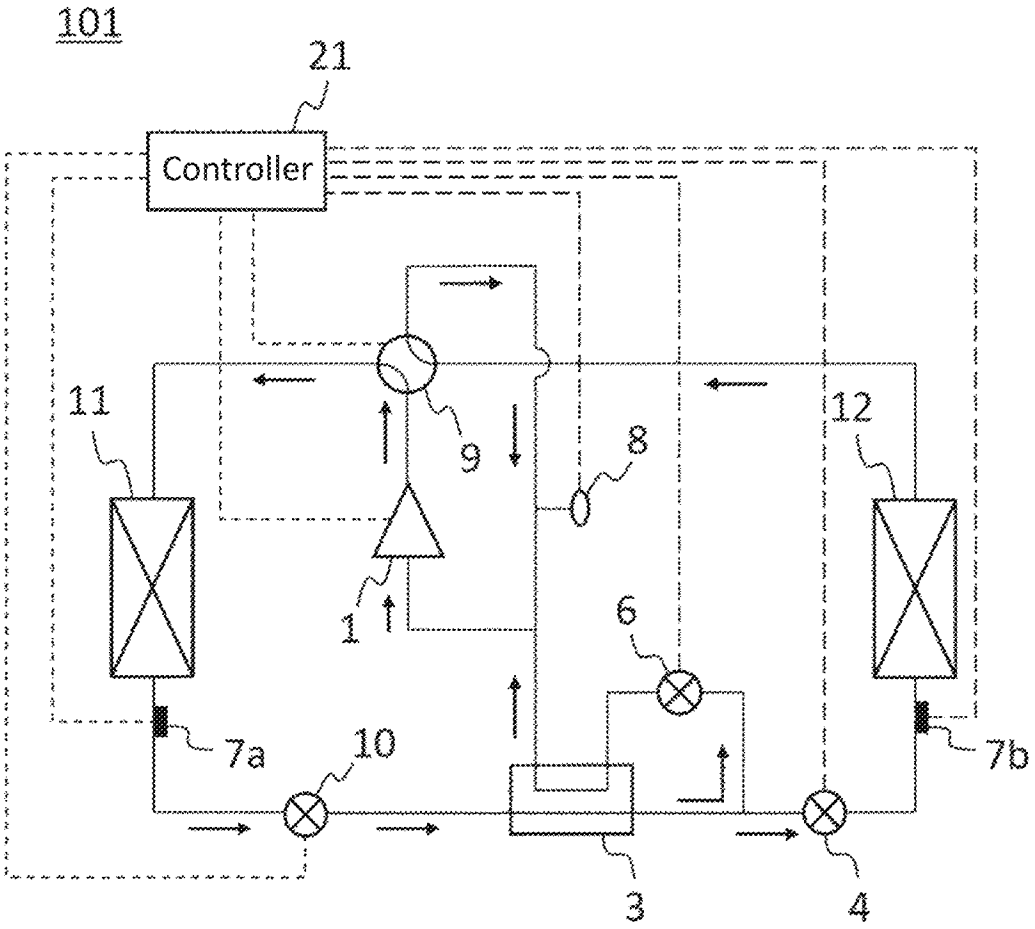
FIG. 11 is a schematic configuration diagram showing a refrigeration cycle device according to Embodiment 2.
Figure 12:
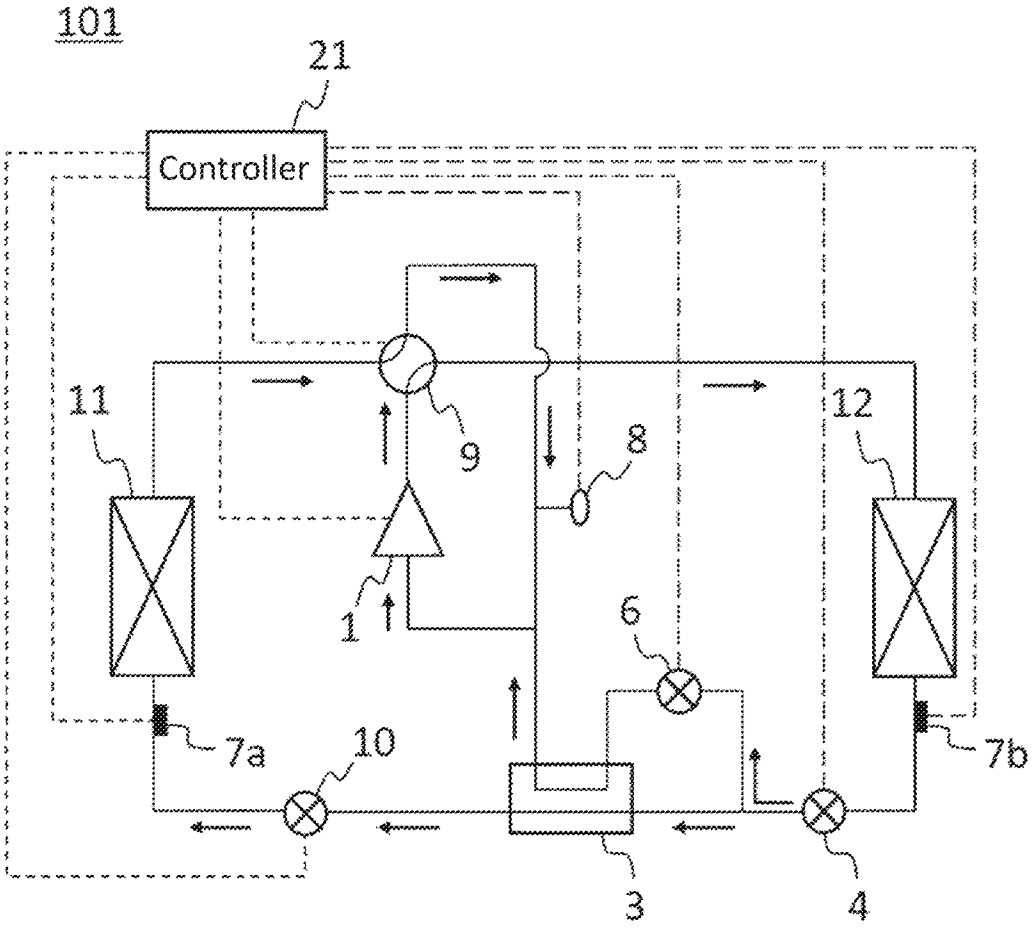
FIG. 12 is a schematic configuration diagram showing the refrigeration cycle device according to Embodiment 2.

FIGS. 11 and 12 are each a configuration diagram schematically showing a refrigeration cycle device 101 according to Embodiment 2. As in Embodiment 1, the refrigeration cycle device 101 according to the present embodiment includes the main circuit through which the refrigerant circulates, the bypass expansion valve 6, the bypass circuit through which the refrigerant circulates, and a controller 21 that controls the opening degree of the bypass expansion valve 6. The present embodiment differs from Embodiment 1 in that the main circuit includes a four-way valve 9, and a first heat exchanger 11 and a second heat exchanger 12 function as both an evaporator and a condenser. The same components as those in Embodiment 1 are marked with the same symbols and their descriptions are omitted.

In the main circuit, the four-way valve 9 is located on the refrigerant outflow side of the compressor 1. The four-way valve 9 switches the refrigerant flow direction between the first direction (direction indicated by the arrows in FIG. 11) and the second direction (direction indicated by the arrows in FIG. 12) in the main circuit. The operation of the four-way valve 9 is controlled by the controller 21. The state of the four-way valve 9 that causes the refrigerant flow direction to be the first direction is called a first state (the state shown in FIG. 11), and the state of the four-way valve 9 that causes the refrigerant flow direction to be the second direction is called a second state (the state shown in FIG. 12).

In the refrigerant circuit shown in FIG. 11, the refrigerant flow direction is the first direction as in Embodiment 1. In the refrigerant circuit shown in FIG. 12, the refrigerant flow direction is not the first direction, but the second direction. That is, when the four-way valve 9 is in the first state, the first heat exchanger 11 serves as a condenser and the second heat exchanger 12 serves as an evaporator, as in Embodiment 1. On the other hand, when the four-way valve 9 is in the second state, the first heat exchanger 11 serves as an evaporator and the second heat exchanger 12 serves as a condenser.

The first heat exchanger 11 is designed such that, when it serves as an evaporator and the refrigerant flows at a specific flow rate, the difference between the temperature at the refrigerant inflow side and the saturated gas temperature at the refrigerant outflow side in the first heat exchanger 11 is controlled to be less than the set temperature difference, thereby causing a pressure loss in the refrigerant. The pressure loss in the first heat exchanger 11 can be adjusted, for example, by changing the number of refrigerant channels (number of passes) or the refrigerant channel diameter in the first heat exchanger 11. The set temperature difference is two degrees C., for example.

The second heat exchanger 12 is also designed such that, when it serves as an evaporator and the refrigerant flows at a specific flow rate, the difference between the temperature at the refrigerant inflow side and the saturated gas temperature at the refrigerant outflow side in the second heat exchanger 12 is controlled to be less than the set temperature difference, thereby causing a pressure loss in the refrigerant. The pressure loss in the second heat exchanger 12 can be adjusted, for example, by changing the number of refrigerant channels (number of passes) or the refrigerant channel diameter in the second heat exchanger 12. The set temperature difference is two degrees C., for example. As for the above-mentioned specific refrigerant flow rate when the difference between the temperature at the inflow side and the saturated gas temperature of the evaporating refrigerant is controlled to be less than the set temperature difference, the first heat exchanger 11 and the second heat exchanger 12 may be given the same flow rate or different flow rates from each other.

The main circuit in the refrigeration cycle device 101 includes a second expansion valve. In the examples in FIGS. 11 and 12, the second expansion valve is located between the first heat exchanger 11 and the supercooling heat exchanger 3. The second expansion valve sucks in the liquid refrigerant of low temperature and high pressure cooled by the condenser and decompresses and expands it into the liquid or gas-liquid two-phase state of low temperature and low pressure. The second expansion valve is a main expansion valve (a main pressure reducing device), which includes a refrigerant flow rate control means such as an electronic expansion valve and a temperature-sensitive expansion valve, and a capillary tube, for example. When the first heat exchanger 11 serves as an evaporator, the refrigerant, decompressed and expanded by the second expansion valve, flows into the first heat exchanger 11. Similarly for the first expansion valve 4, when the second heat exchanger 12 serves as an evaporator, the refrigerant, decompressed and expanded by the first expansion valve 4, flows into the second heat exchanger 12.

The refrigeration cycle device 101 according to the present embodiment includes a plurality of the first sensors. The plurality of first sensors is located such that they can obtain the temperatures of the refrigerants flowing into the first heat exchanger 11 and the second heat exchanger 12. Specifically, one of the plurality of first sensors is located so as to obtain the temperature at the refrigerant inflow side of the first heat exchanger 11 serving as an evaporator, and another is located so as to obtain the temperature at the refrigerant inflow side of the second heat exchanger 12 serving as an evaporator.

In the examples shown in FIGS. 11 and 12, there are two of the first sensors. One of them, or a first sensor 7*a*, is located between the refrigerant inflow side of the first heat exchanger 11 and the refrigerant outflow side of the second expansion valve 10 when the first heat exchanger 11 serves as an evaporator, in other words, when the refrigerant flow direction is the second direction. The other one, or a first sensor 7*b*, is located between the refrigerant inflow side of the second heat exchanger 12 and the refrigerant outflow side of the first expansion valve 4 when the second heat exchanger 12 serves as an evaporator, in other words, when the refrigerant flow direction is the first direction.

Next, the flow of the refrigerant according to the present embodiment will be described with reference to FIGS. 11 and 12. In FIG. 11, the refrigerant flows from the compressor 1 through the four-way valve 9 into the first heat exchanger 11 (condenser). In the first heat exchanger 11, the refrigerant exchanges heat with the medium to be heated and condenses. The refrigerant flows from the first heat exchanger 11 through the second expansion valve into the supercooling heat exchanger 3 to be cooled by the refrigerant flowing through the bypass circuit.

Then, the refrigerant flows out of the supercooling heat exchanger 3 to be divided into the refrigerant flowing through the main circuit and the refrigerant flowing through the bypass circuit. First, the refrigerant flowing through the main circuit after the flow division will be described. The refrigerant flows from the supercooling heat exchanger 3 into the first expansion valve 4, where it is decompressed, and then into the second heat exchanger 12 (evaporator). In the second heat exchanger 12, the refrigerant exchanges heat with the medium to be cooled and evaporates. The evaporated refrigerant is sucked into the compressor 1 through the four-way valve 9. The refrigerant flowing into the bypass expansion valve 6 is decompressed there, flows into the supercooling heat exchanger 3, cools the refrigerant before the flow division, evaporates, merges with the refrigerant from the main circuit, and is sucked into the compressor 1. When the bypass expansion valve 6 is fully closed, the refrigerant does not flow into the bypass circuit.

The flow of the refrigerant in FIG. 12 is different from the flow of the refrigerant in FIG. 11. First, the refrigerant flows from the compressor 1 through the four-way valve 9 into the second heat exchanger 12 (condenser). In the second heat exchanger 12, the refrigerant exchanges heat with the medium to be heated and condenses. The refrigerant flows from the second heat exchanger 12 to be divided into the refrigerant flowing through the main circuit and the refrigerant flowing through the bypass circuit. The refrigerant flowing through the main circuit after the flow division will be described. The refrigerant flows through the first expansion valve 4 into the supercooling heat exchanger 3 to be cooled there by the refrigerant flowing through the bypass circuit. Then, the refrigerant flows from the supercooling heat exchanger 3 through the second expansion valve 10 where it is decompressed and enters the first heat exchanger 11 (evaporator). In the first heat exchanger 11, the refrigerant exchanges heat with the medium to be cooled and evaporates. The evaporated refrigerant merges with the refrigerant flowing through the main circuit and is sucked into the compressor 1. When the bypass expansion valve 6 is fully closed, the refrigerant does not flow into the bypass circuit.

As in Embodiment 1, the pressure reduction by the bypass expansion valve 6 makes the refrigerant flowing through the bypass circuit cooler than the high-pressure side refrigerant flowing through the supercooling heat exchanger 3. Thus, the refrigerant flowing through the bypass circuit can cool the refrigerant flowing through the main circuit via the supercooling heat exchanger 3. Regardless of whether the four-way valve 9 is in the first state or the second state, the circulation of the refrigerant in the bypass circuit reduces the refrigerant flow rate into the evaporator, but does not reduce the heat exchange amount in the evaporator due to the decrease in the enthalpy of the refrigerant flowing into the evaporator. On the other hand, the decrease in the refrigerant flow rate into the evaporator reduces the pressure loss in the evaporator. An increase in the opening degree of the bypass expansion valve 6 causes an increase in the heat exchange amount in the supercooling heat exchanger 3 and a decrease in the refrigerant flow rate into the evaporator. That is, the pressure loss in the evaporator can be adjusted by controlling the opening degree of the bypass expansion valve 6.

The controller 21 calculates the refrigerant temperature and the saturated gas temperature by using the sensor information obtained from the first sensors 7*a* and 7*b* and the second sensor 8, respectively, controls the opening degree of the bypass expansion valve 6, and thereby adjusts the refrigerant flow rates through the main circuit and the bypass circuit. The operation of the controller 21 will be described below, along with examples of the operation state of the refrigeration cycle device 101 according to the present embodiment. The operation of the controller 21 described below is performed when the refrigerant temperature at the refrigerant inflow side or the saturated gas temperature at the refrigerant outflow side of the evaporator falls below the set temperature. The above-mentioned set the temperature is, for example, two degrees C.

First, the first example of the operation state of the refrigeration cycle device 101 will be described.

Figure 13:
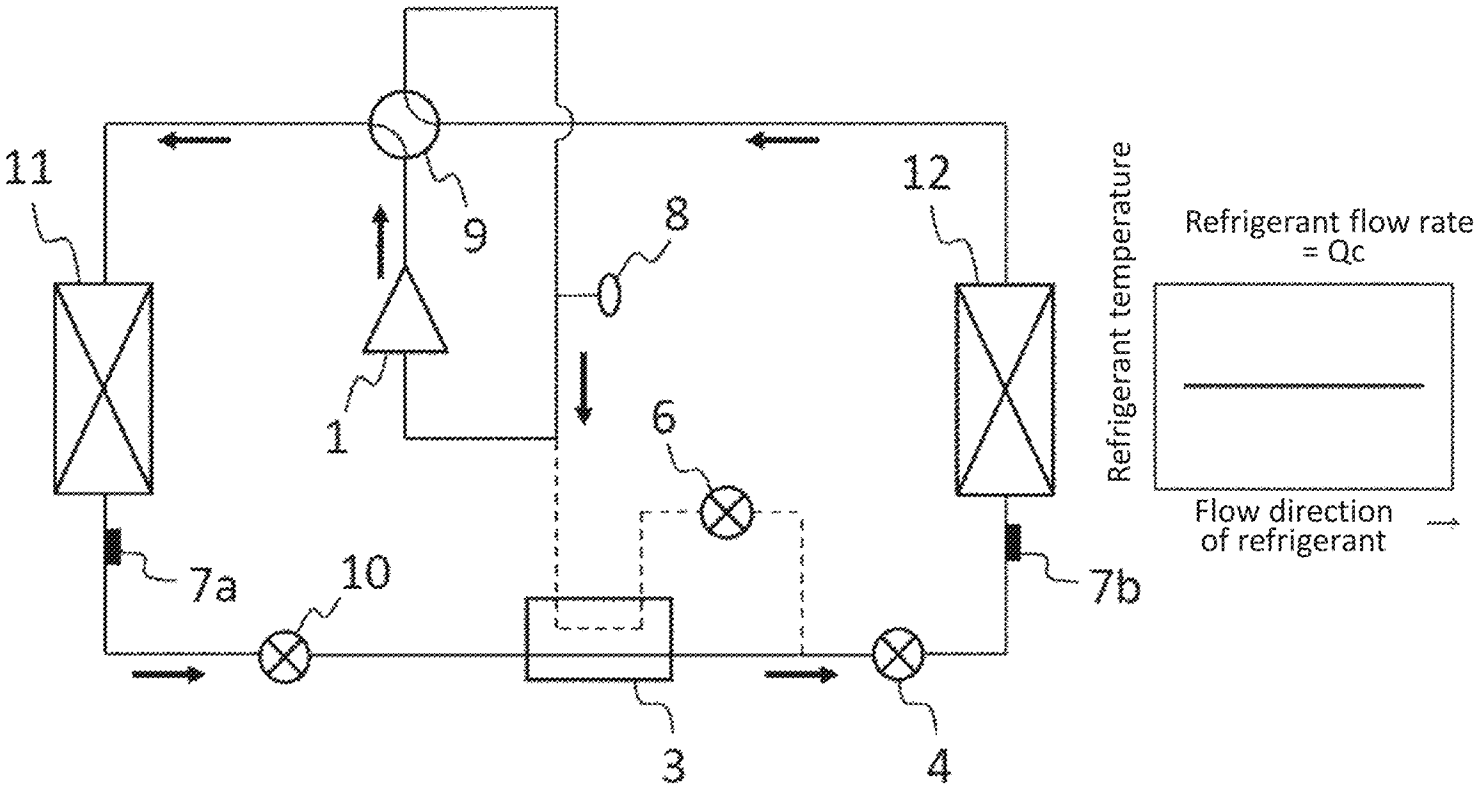
FIG. 13 is an explanatory diagram showing the first example of the operation state of the refrigeration cycle device according to Embodiment 2.

FIG. 13 is an explanatory diagram showing the first example of the operation state of the refrigeration cycle device 101 according to Embodiment 2. The first example is an example of the operation state of the refrigeration cycle device 101 in which the four-way valve 9 is in the first state. In the first example, the second heat exchanger 12 is designed such that the difference between the temperature at the refrigerant inflow side and the saturated gas temperature at the refrigerant outflow side is less than two degrees C. when the refrigerant flow rate from the compressor 1 is Qc and the refrigerant flow rate into the second heat exchanger 12 is Qc. In the first example, the bypass expansion valve 6 is fully closed, and the refrigerant flow rate into the second heat exchanger 12 is Qc, so that the difference between the temperature at the refrigerant inflow side and the saturated gas temperature of the second heat exchanger 12 is less than two degrees C. In the first example, this suppresses the uneven frost formation on the surface of the second heat exchanger 12.

Next, the second example of the operation state of the refrigeration cycle device 101 will be described.

Figure 14:
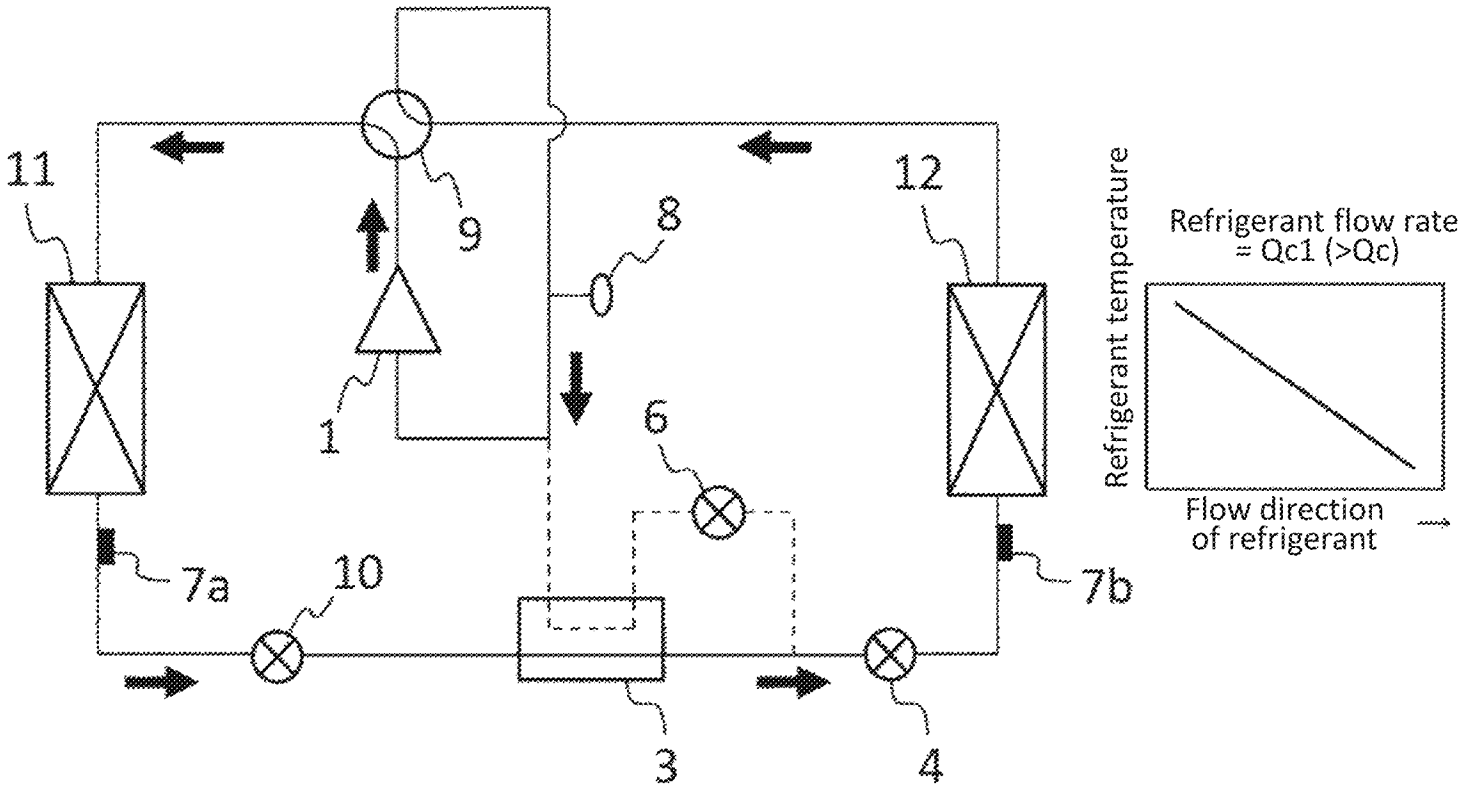
FIG. 14 is an explanatory diagram showing the second example of the operation state of the refrigeration cycle device according to Embodiment 2.

FIG. 14 is an explanatory diagram showing the second example of the operation state of the refrigeration cycle device 101 according to Embodiment 2. The second example is an example of the operation state of the refrigeration cycle device 101 in which the four-way valve 9 is in the first state. FIG. 14 shows an example, in which the refrigerant flow rate from the compressor 1 is Qc1, which is greater than Qc, and the bypass expansion valve 6 is fully closed. In this case, since the refrigerant flow rate into the second heat exchanger 12 is Qc1, the pressure loss of the refrigerant within the second heat exchanger 12 is higher compared to when the refrigerant flow rate into the second heat exchanger 12 is Qc. This causes the saturated gas temperature at the refrigerant outflow side to be lower than the temperature at the refrigerant inflow side in the second heat exchanger 12, so that the uneven frost formation may occur at the refrigerant outflow side in the second heat exchanger 12. However, the uneven frost formation on the second heat exchanger 12 is suppressed by opening the bypass expansion valve 6 as shown in the third example of the operation state of the refrigeration cycle device 101 described below.

Figure 15:
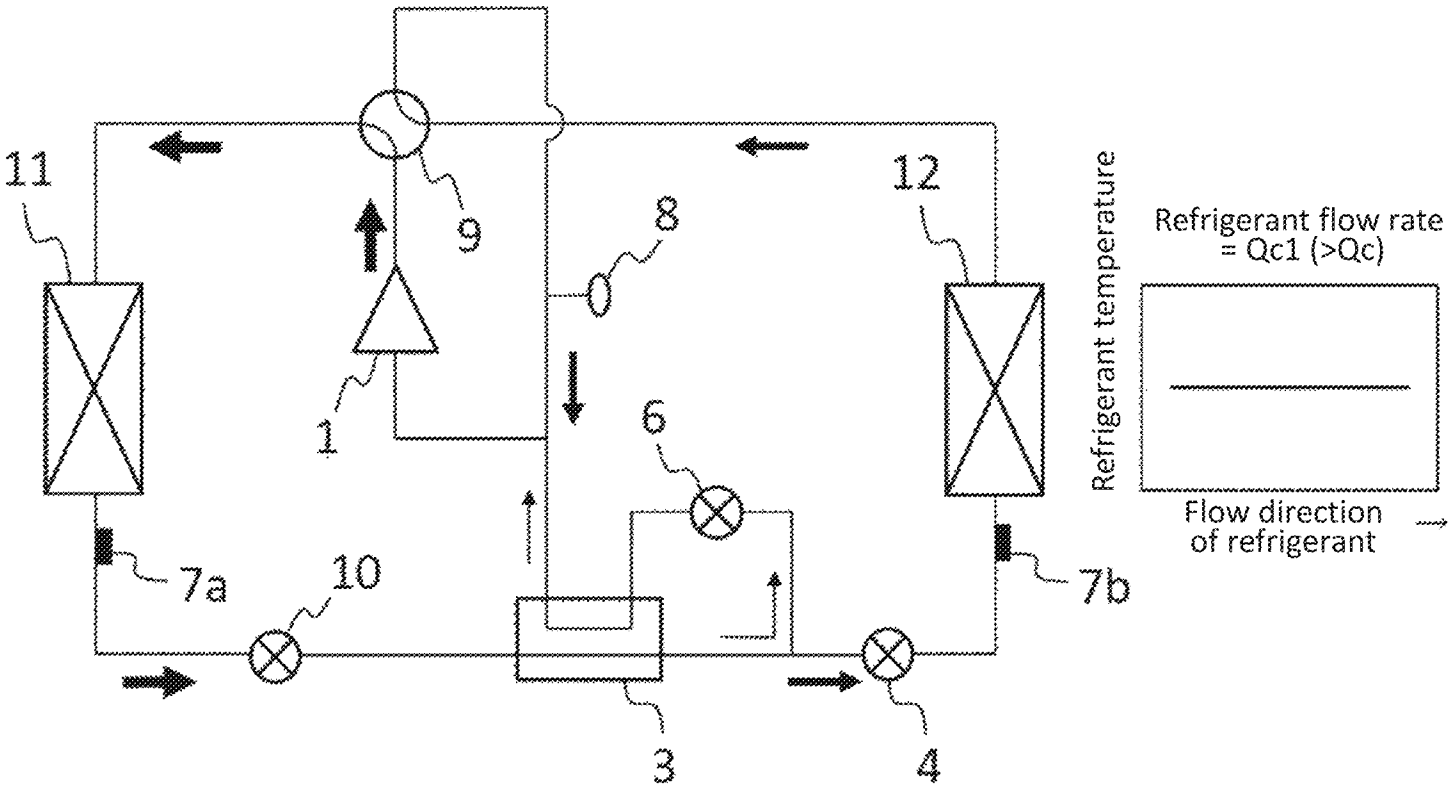
FIG. 15 is an explanatory diagram showing the third example of the operation state of the refrigeration cycle device according to Embodiment 2.

FIG. 15 is an explanatory diagram showing the third example of the operation state of the refrigeration cycle device 101 according to Embodiment 2. FIG. 15 shows an example, in which the bypass expansion valve 6 is in an open state and the refrigerant flow rate from the compressor 1 is Qc1, which is the same as in the second example. The controller 21 calculates the refrigerant temperature and the saturated gas temperature of the second heat exchanger 12 using the sensor information obtained from the first sensor 7*b* on the side of the second heat exchanger 12 and the second sensor 8, respectively. The controller 21 compares the refrigerant temperature and the saturated gas temperature when the difference between the refrigerant temperature and the saturated gas temperature in the second heat exchanger 12 is equal to or greater than the set temperature difference. When the saturated gas temperature is lower than the refrigerant temperature, the controller 21 opens the bypass expansion valve 6 to reduce the refrigerant flow rate through the main circuit. The reduction of the refrigerant flow rate through the main circuit reduces the refrigerant flow rate into the second heat exchanger 12, so that the pressure loss of the refrigerant in the second heat exchanger 12 is reduced. Therefore, the temperature drop at the refrigerant outflow side of the second heat exchanger 12 can be suppressed, and thus the uneven frost formation at the refrigerant outflow side of the second heat exchanger 12, or the evaporator, can be suppressed.

On the other hand, even when the four-way valve 9 is in the second state, the uneven frost formation on the evaporator can be suppressed by controlling the opening degree of the bypass expansion valve 6 as in the case when the four-way valve 9 is in the first state. First, the fourth example of the operation state of the refrigeration cycle device 101 will be described. In the following description, the refrigerant temperature at the refrigerant inflow side of the first heat exchanger 11 is simply referred to as the refrigerant temperature, and the saturated gas temperature at the refrigerant outflow side of the second heat exchanger 12 is simply referred to as the saturated gas temperature.

Figure 16:
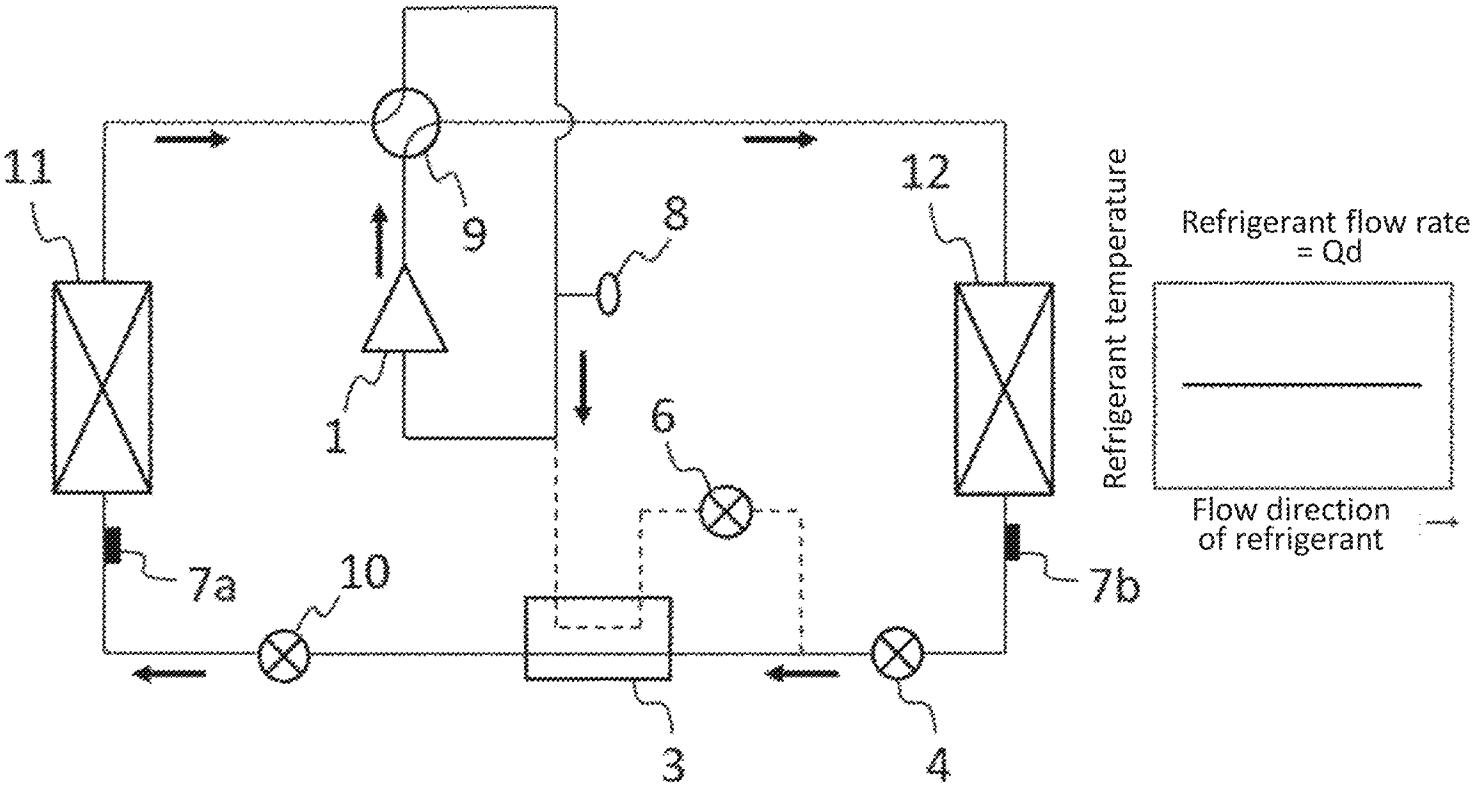
FIG. 16 is an explanatory diagram showing the fourth example of the operation state of the refrigeration cycle device according to Embodiment 2.

FIG. 16 is an explanatory diagram showing the fourth example of the operation state of the refrigeration cycle device 101 according to Embodiment 2. The fourth example is an example of the operation state of the refrigeration cycle device 101 in which the four-way valve 9 is in the second state. In the fourth example, the first heat exchanger 11 is designed such that the difference between the temperature at the refrigerant inflow side and the saturated gas temperature is less than two degrees C. when the refrigerant flow rate from the compressor 1 is Qd and the refrigerant flow rate into the first heat exchanger 11 is Qd. In the fourth example, the bypass expansion valve 6 is fully closed, and the refrigerant flow rate into the first heat exchanger 11 is Qd, so that the difference between the temperature at the refrigerant inflow side and the saturated gas temperature of the first heat exchanger 11 is less than two degrees C. In the fourth example, this suppresses the uneven frost formation on the surface of the first heat exchanger 11.

Next, the fifth example of the operation state of the refrigeration cycle device 101 will be described.

Figure 17:
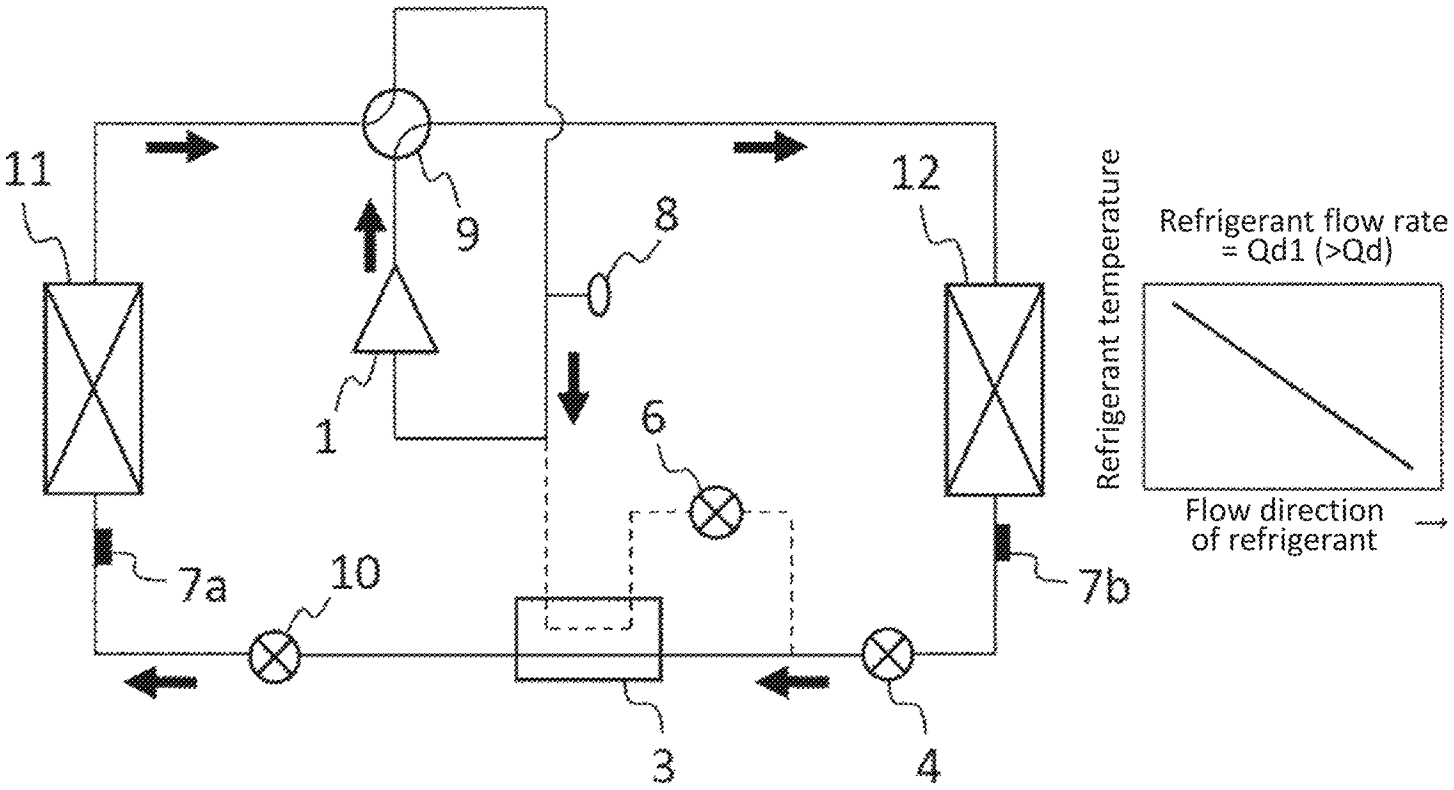
FIG. 17 is an explanatory diagram showing the fifth example of the operation state of the refrigeration cycle device according to Embodiment 2.

FIG. 17 is an explanatory diagram showing the fifth example of the operation state of the refrigeration cycle device 101 according to Embodiment 2. The fifth example is an example of the operation state of the refrigeration cycle device 101 in which the four-way valve 9 is in the second state. FIG. 17 shows an example, in which the refrigerant flow rate from the compressor 1 is Qd1, which is greater than Qd, and the bypass expansion valve 6 is fully closed. In this case, since the refrigerant flow rate into the first heat exchanger 11 is Qd1, the pressure loss of the refrigerant within the first heat exchanger 11 is higher compared to when the refrigerant flow rate into the first heat exchanger 11 is Qd. This causes the saturated gas temperature at the refrigerant outflow side to be lower than the temperature at the refrigerant inflow side in the first heat exchanger 11, so that the uneven frost formation may occur at the refrigerant outflow side in the first heat exchanger 11. However, the uneven frost formation on the first heat exchanger 11 is suppressed by opening the bypass expansion valve 6 as shown in the sixth example of the refrigeration cycle device 101 described below.

Figure 18:
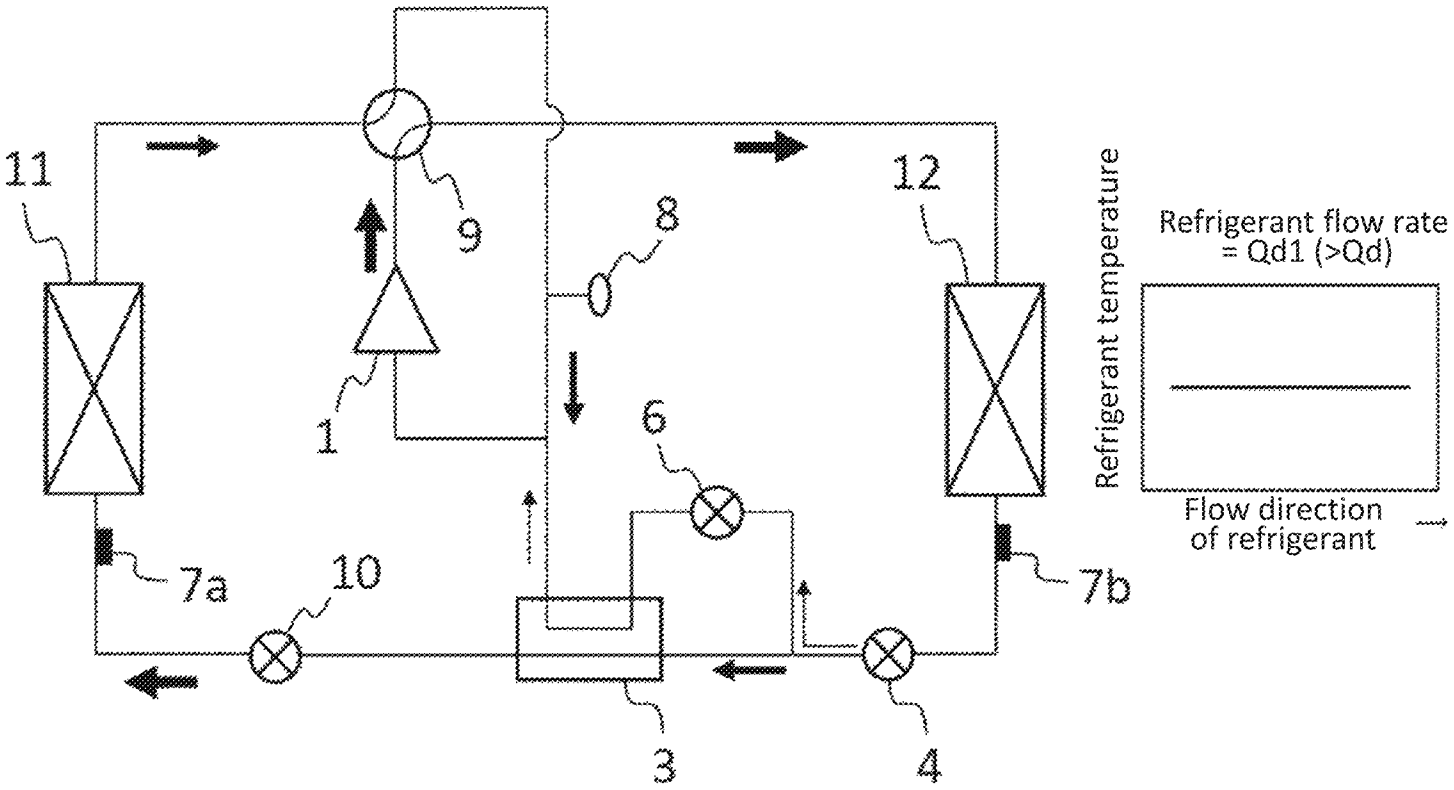
FIG. 18 is an explanatory diagram showing the sixth example of the operation state of the refrigeration cycle device according to Embodiment 2.

FIG. 18 is an explanatory diagram showing the sixth example of the operation state of the refrigeration cycle device 101 according to Embodiment 2. FIG. 18 shows an example, in which the bypass expansion valve 6 is in an open state and the refrigerant flow rate from the compressor 1 is Qd1, which is the same as in the fifth example. The controller 21 calculates the refrigerant temperature and the saturated gas temperature of the first heat exchanger 11 using the sensor information obtained from the first sensor 7*a* on the side of the first heat exchanger 11 and the second sensor 8, respectively. The controller 21 compares the refrigerant temperature and the saturated gas temperature when the difference between the refrigerant temperature and the saturated gas temperature in the first heat exchanger 11 is equal to or greater than the set temperature difference. When the saturated gas temperature is lower than the refrigerant temperature, the controller 21 opens the bypass expansion valve 6 to reduce the refrigerant flow rate through the main circuit. The reduction of the refrigerant flow rate through the main circuit reduces the refrigerant flow rate into the first heat exchanger 11, so that the pressure loss of the refrigerant in the first heat exchanger 11 is reduced. Therefore, the temperature drop at the refrigerant outflow side of the first heat exchanger 11 can be suppressed, and thus the uneven frost formation at the refrigerant outflow side of the first heat exchanger 11, or the evaporator, can be suppressed.

As described above in Embodiment 1 using the fourth to the sixth examples of the operation state of the refrigeration cycle device 100, also even when the first heat exchanger 11 and the second heat exchanger 12 are designed such that, with the refrigerant being divided and flowing into the bypass circuit and the main circuit, the difference between the temperature at the refrigerant inflow side and the saturated gas temperature is less than the set temperature difference in each of the first heat exchanger 11 and the second heat exchanger 12, the uneven frost formation on the evaporator can be suppressed by the controller 21 controlling the opening degree of the bypass expansion valve 6. No further description of this will be given here.

Figure 19:
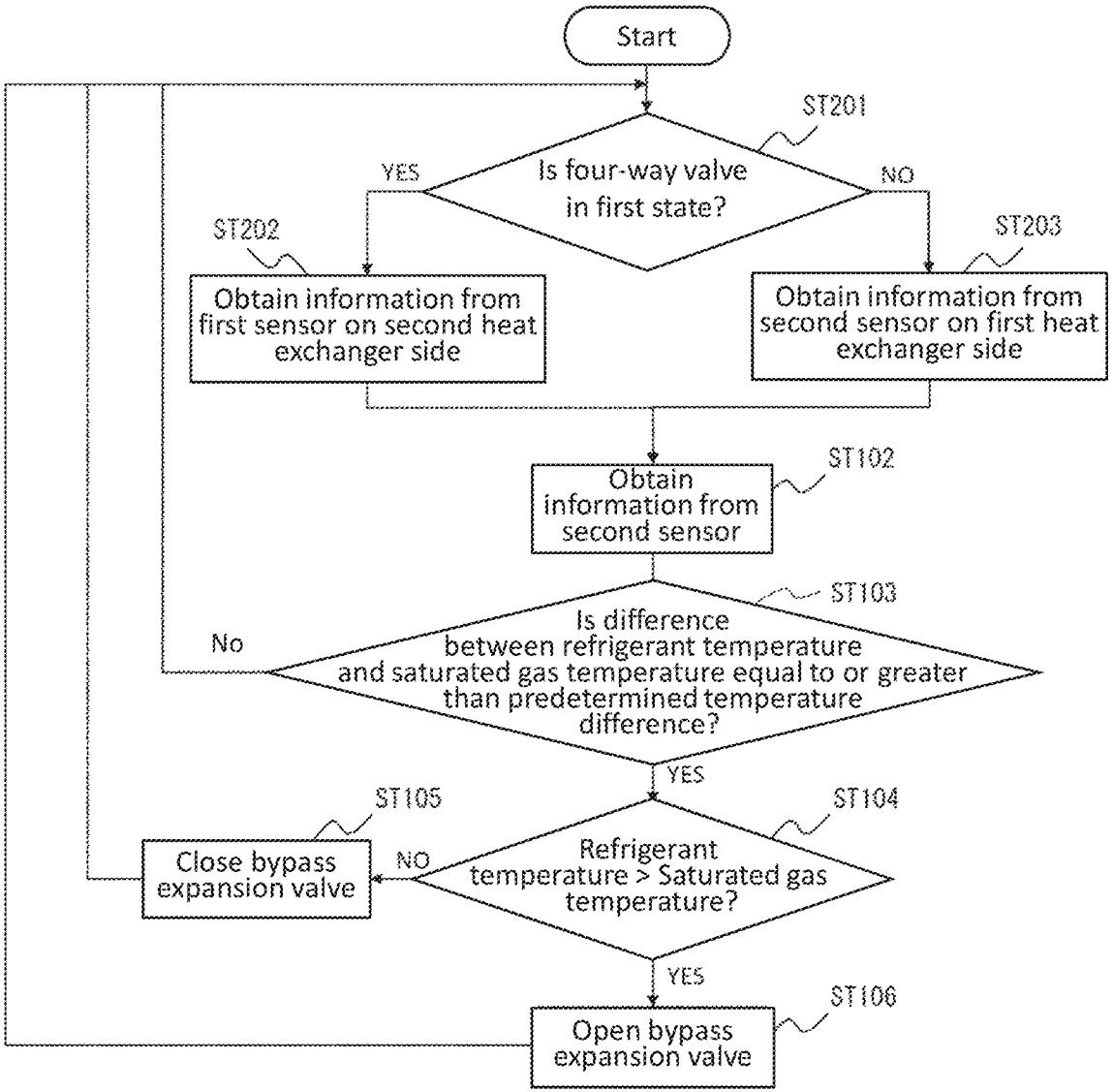
FIG. 19 is a flowchart showing an example of an operation of a controller of the refrigeration cycle device according to Embodiment 2.

The control flow of the controller 21 according to the present embodiment is as follows. FIG. 19 is a flowchart showing an example of the operation of the controller 21 of the refrigeration cycle device 101 according to Embodiment 2. In the following, the steps identical to those described in Embodiment 1 are assigned the same symbols as those in FIG. 9, and their descriptions are omitted or simplified.

Although the flowchart in FIG. 19 does not include a process for terminating the operation of the controller 21, the controller 21 terminates its operation, for example, when it receives a command to terminate its operation from a remote controller or the like.

First, the controller 21 obtains information from the four-way valve 9 as to whether the four-way valve 9 is in the first state or in the second state (ST201). If the state of the four-way valve 9 is the first state (ST201; YES), the controller 21 obtains the sensor information from the first sensor 7*b* on the side of the second heat exchanger 12. If the state of the four-way valve 9 is not the first state, i.e., the second state (ST201; NO), the controller 21 obtains the sensor information from the first sensor 7*a* on the side of the first heat exchanger 11. The sensor information that the controller 21 obtains from the first sensors 7*a* and 7*b* is the temperatures of the refrigerants flowing into the first heat exchanger 11 and the second heat exchanger 12, respectively.

Then, the controller 21 obtains the sensor information indicating the pressure of the refrigerant from the second sensor 8 (ST102). Next, the controller 21 compares the refrigerant temperature and the saturated gas temperature using the obtained sensor information to determine whether the difference between the refrigerant temperature and the saturated gas temperature is greater than or equal to the set temperature difference (ST103). If the difference between the refrigerant temperature and the saturated gas temperature is less than the set temperature difference (ST103; NO), the operation of the controller 21 proceeds to the processing of ST201.

If the difference between the refrigerant temperature and the saturated gas temperature is equal to or greater than the set temperature difference (ST103; YES), the controller 21 compares the refrigerant temperature and the saturated gas temperature to determine which of the refrigerant temperature and the saturated gas temperature is lower (ST104).

If the saturated gas temperature is lower than the refrigerant temperature (ST104; YES), the controller 21 opens the bypass expansion valve 6 to reduce the refrigerant flow rate through the main circuit. Opening the bypass expansion valve 6 reduces the refrigerant flow rate into the evaporator (the first heat exchanger 11 or the second heat exchanger 12), which reduces the pressure loss of the refrigerant within the evaporator. Therefore, the temperature drop at the refrigerant outflow side of the evaporator can be suppressed, and thus the uneven frost formation at the refrigerant outflow side of the evaporator can be suppressed. Then, the operation of the controller 21 proceeds to the processing of ST201.

On the other hand, if the refrigerant temperature is lower than the saturated gas temperature (ST104; NO), the controller 21 closes the bypass expansion valve 6 and increases the refrigerant flow rate through the main circuit. Closing the bypass expansion valve 6 increases the refrigerant flow rate into the evaporator (the first heat exchanger 11 or the second heat exchanger 12), which increases the pressure loss of the refrigerant within the evaporator. Therefore, the temperature drop at the refrigerant inflow side of the evaporator can be suppressed, and thus the uneven frost formation at the refrigerant inflow side of the evaporator can be suppressed. Then, the operation of the controller 21 proceeds to the processing of ST201. In the open/close control of the bypass expansion valve 6 by the controller 21 described above, it is possible to adjust the amount by which the bypass expansion valve 6 is opened.

As described above, even in a case where the refrigeration cycle device 101 is designed such that the first heat exchanger 11 and the second heat exchanger 12 serve alternately as an evaporator or a condenser, the adjustment of the refrigerant flow rates through the main circuit and the bypass circuit, enabled by the control of the opening degree of the bypass expansion valve 6, can offset the temperature increase due to the temperature gradient of the refrigerant and the temperature drop due to the pressure loss in the evaporation process of the refrigerant. This reduces the temperature difference between the inflow and outflow sides of the evaporator, thus suppressing the uneven frost formation on the evaporator and preventing degradation of heat exchange performance. Furthermore, by controlling the opening degree of the bypass expansion valve 6 and by using the supercooling heat exchanger 3, the refrigerant flow rate into the evaporator can be changed to ensure a certain amount of heat exchange in the evaporator.

In the refrigeration cycle device 101 according to the present embodiment shown in FIGS. 11 through 18, it is shown as an example that the bypass circuit is branched from between the supercooling heat exchanger 3 and the first expansion valve 4 when the four-way valve 9 is in the first state, but the bypass circuit may be branched from anywhere between the supercooling heat exchanger 3 and the second heat exchanger 12 when the four-way valve 9 is in the first state.

In Embodiments 1 and 2, the first sensor 7 obtains the temperature of the refrigerant flowing into the evaporator, but this example is not limiting. For example, the first sensor 7 may be provided to the inlet of the evaporator to obtain the temperature there as long as the sensor can obtain the temperature at the refrigerant inflow side of the evaporator.

DESCRIPTION OF SYMBOLS

1 . . . compressor,
2, 11 . . . first heat exchanger,
3 . . . supercooling heat exchanger,
4 . . . first expansion valve,
5, 12 . . . second heat exchanger,
6 . . . bypass expansion valve,
7, 7*a*, 7*b* . . . first sensor,
8 . . . second sensor,
9 . . . four-way valve,
10 . . . second expansion valve,
20, 21 . . . controller,
100, 101 . . . refrigeration cycle device.

The invention claimed is:

1. A refrigeration cycle device with a main circuit in which a compressor, a condenser, a supercooling heat exchanger, a main expansion valve, and an evaporator are connected by refrigerant piping to circulate a non-azeotropic mixed refrigerant, and a bypass circuit branched from between the condenser and the evaporator to be connected to a refrigerant inflow side of the compressor, the bypass circuit including a bypass expansion valve to introduce the non-azeotropic mixed refrigerant from the main circuit, the supercooling heat exchanger exchanging heat between the non-azeotropic mixed refrigerant flowing through the main circuit and the non-azeotropic mixed refrigerant flowing through the bypass circuit, the refrigeration cycle device comprising:

a controller to control an opening degree of the bypass expansion valve;

a first sensor between the main expansion valve and the evaporator along a refrigerant flow direction of the main circuit such that the first sensor is configured to detect a temperature at a refrigerant inflow side of the evaporator; and a second sensor to detect a pressure of the non-azeotropic mixed refrigerant flowing from the evaporator, wherein the controller controls the opening degree of the bypass expansion valve using the temperature at the refrigerant inflow side of the evaporator detected by the first sensor and a saturated gas temperature of the non-azeotropic mixed refrigerant calculated from the pressure detected by the second sensor and adjusts a flow rate of the non-azeotropic mixed refrigerant flowing into the evaporator.

2. The refrigeration cycle device according to claim 1, wherein when the saturated gas temperature is lower than the temperature at the refrigerant inflow side of the evaporator, the controller increases the opening degree of the bypass expansion valve to reduce the flow rate of the non-azeotropic mixed refrigerant into the evaporator.

3. The refrigeration cycle device according to claim 1, wherein when the saturated gas temperature is higher than the temperature at the refrigerant inflow side of the evaporator, the controller reduces the opening degree of the bypass expansion valve to increase the flow rate of the non-azeotropic mixed refrigerant into the evaporator.

4. The refrigeration cycle device according to claim 1, wherein when the temperature at the refrigerant inflow side or the saturated gas temperature of the evaporator is lower than a set temperature, the controller controls the opening degree of the bypass expansion valve to reduce the temperature difference between the refrigerant inflow side and a refrigerant outflow side of the evaporator.

5. The refrigeration cycle device according to claim 1, wherein when the temperature at the refrigerant inflow side or the saturated gas temperature of the evaporator is lower than a set temperature, the controller controls the opening degree of the bypass expansion valve to reduce the temperature difference between the refrigerant inflow side and a refrigerant outflow side of the evaporator to be less than a set temperature difference.

6. The refrigeration cycle device according to claim 1, wherein the bypass circuit is branched from between the supercooling heat exchanger and the evaporator.

7. The refrigeration cycle device according to claim 1, wherein the bypass circuit is branched from between the supercooling heat exchanger and the main expansion valve.

8. The refrigeration cycle device according to claim 1, wherein, in the evaporator, when the flow rate of the non-azeotropic mixed refrigerant flowing through the evaporator is a specific set value, the difference between the temperature at the refrigerant inflow side and the saturated gas temperature of the evaporator is less than a set temperature difference.

9. The refrigeration cycle device according to claim 1, wherein the non-azeotropic mixed refrigerant contains any one of an olefin refrigerant, an ether refrigerant, a hydrocarbon refrigerant, an ethane refrigerant, a methane refrigerant, and a refrigerant with a lower gas density than difluoromethane.

10. The refrigeration cycle device according to claim 1, wherein the controller controls the opening degree of the bypass expansion valve by comparing the temperature at the refrigerant inflow side of the evaporator detected by the first sensor with the saturated gas temperature of the non-azeotropic mixed refrigerant calculated from the pressure detected by the second sensor and adjusts the flow rate of the non-azeotropic mixed refrigerant flowing into the evaporator.

11. A refrigeration cycle device with a main circuit in which a compressor, a condenser, a supercooling heat exchanger, a main expansion valve, and an evaporator are connected by refrigerant piping to circulate a non-azeotropic mixed refrigerant, and a bypass circuit branched from between the condenser and the evaporator to be connected to a refrigerant inflow side of the compressor, the bypass circuit including a bypass expansion valve to introduce the non-azeotropic mixed refrigerant from the main circuit, the supercooling heat exchanger exchanging heat between the non-azeotropic mixed refrigerant flowing through the main circuit and the non-azeotropic mixed refrigerant flowing through the bypass circuit, the refrigeration cycle device comprising:

a controller to control an opening degree of the bypass expansion valve;

a first sensor to detect a temperature at a refrigerant inflow side of the evaporator; and a second sensor to detect a pressure of the non-azeotropic mixed refrigerant flowing from the evaporator, wherein the controller controls the opening degree of the bypass expansion valve using the temperature at the refrigerant inflow side of the evaporator detected by the first sensor and a saturated gas temperature of the non-azeotropic mixed refrigerant calculated from the pressure detected by the second sensor and adjusts a flow rate of the non-azeotropic mixed refrigerant flowing into the evaporator, when the saturated gas temperature is lower than the temperature at the refrigerant inflow side of the evaporator, the controller increases the opening degree of the bypass expansion valve to reduce the flow rate of the non-azeotropic mixed refrigerant into the evaporator, and when the saturated gas temperature is higher than the temperature at the refrigerant inflow side of the evaporator, the controller reduces the opening degree of the bypass expansion valve to increase the flow rate of the non-azeotropic mixed refrigerant into the evaporator.

12. A refrigeration cycle device with a main circuit in which a compressor, a condenser, a supercooling heat exchanger, a main expansion valve, and an evaporator are connected by refrigerant piping to circulate a non-azeotropic mixed refrigerant, and a bypass circuit branched from between the condenser and the evaporator to be connected to a refrigerant inflow side of the compressor, the bypass circuit including a bypass expansion valve to introduce the non-azeotropic mixed refrigerant from the main circuit, the supercooling heat exchanger exchanging heat between the non-azeotropic mixed refrigerant flowing through the main circuit and the non-azeotropic mixed refrigerant flowing through the bypass circuit, the refrigeration cycle device comprising:

a controller to control an opening degree of the bypass expansion valve;

a first sensor to detect a temperature at a refrigerant inflow side of the evaporator; and a second sensor to detect a pressure of the non-azeotropic mixed refrigerant flowing from the evaporator, wherein the controller controls the opening degree of the bypass expansion valve using the temperature at the refrigerant inflow side of the evaporator detected by the first sensor and a saturated gas temperature of the non-azeotropic mixed refrigerant calculated from the pressure detected by the second sensor and adjusts a flow rate of the non-azeotropic mixed refrigerant flowing into the evaporator, and when the temperature at the refrigerant inflow side or the saturated gas temperature of the evaporator is lower than a set temperature, the controller controls the opening degree of the bypass expansion valve to reduce the temperature difference between the refrigerant inflow side and a refrigerant outflow side of the evaporator.

* * * * *